US008841827B2

(12) United States Patent
Sakayanagi et al.

(10) Patent No.: US 8,841,827 B2
(45) Date of Patent: Sep. 23, 2014

(54) SPARK PLUG WITH IMPROVED RESISTANCE TO SPARK-INDUCED EROSION OF THE GROUND ELECTRODE TIP

(75) Inventors: Nobuaki Sakayanagi, Aichi (JP); Katsutoshi Nakayama, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 27 days.

(21) Appl. No.: 13/876,181

(22) PCT Filed: Sep. 22, 2011

(86) PCT No.: PCT/JP2011/005343

§ 371 (c)(1), (2), (4) Date: Mar. 27, 2013

(87) PCT Pub. No.: WO2012/042801

PCT Pub. Date: Apr. 5, 2012

(65) Prior Publication Data

US 2013/0200773 A1 Aug. 8, 2013

(30) Foreign Application Priority Data

Sep. 29, 2010 (JP) ..... 2010-218513

(51) Int. Cl.
*H01T 13/20* (2006.01)
*H01T 13/32* (2006.01)

(52) U.S. Cl.
CPC ..... *H01T 13/20* (2013.01); *H01T 13/32* (2013.01)
USPC ..... 313/141; 313/118

(58) Field of Classification Search
CPC ..... H01T 13/20; H01T 13/32; H01T 13/34; H01T 13/39
USPC ..... 313/141, 118
See application file for complete search history.

(56) References Cited

U.S. PATENT DOCUMENTS 6,215,235 B1 4/2001 Osamura ..... 313/141
6,337,533 B1 1/2002 Hanashi et al. ..... 313/141

(Continued)

FOREIGN PATENT DOCUMENTS

EP 0 936 710 8/1999 ..... H01T 13/39
EP 2 216 861 8/2010 ..... H01T 13/20

(Continued)

OTHER PUBLICATIONS

Form PCT/ISA/210—Int'l Search Report (from corresponding Int'l Patent App. No. PCT/JP2011/005343—English version only); 1 page.

(Continued)

*Primary Examiner* — Sikha Roy
(74) *Attorney, Agent, or Firm* — Kusner & Jaffe

(57) ABSTRACT

In a spark plug, a fusion zone where a ground electrode and a noble metal tip are fused together is formed in at least a portion of an interfacial region between the ground electrode and the noble metal tip. When the fusion zone is projected in the axial direction, the projected fusion zone overlaps 70% or more of the area of the noble metal tip. As viewed on a section which passes through the center of gravity of the noble metal tip and is perpendicular to the longitudinal direction of the ground electrode, the relational expression 1.3≤B/A is satisfied, where A is the greatest thickness of the fusion zone along the axial direction, and B is the length from a portion having the greatest thickness of the fusion zone to the inner end of the fusion zone.

15 Claims, 17 Drawing Sheets

(56) References Cited

U.S. PATENT DOCUMENTS

| | | | | |
|---|---|---|---|---|
| 6,642,638 | B2 | 11/2003 | Ishiguro | 313/141 |
| 8,188,641 | B2 | 5/2012 | Kameda et al. | 313/142 |
| 2002/0017846 | A1 | 2/2002 | Hori | 313/141 |
| 2005/0176332 | A1 | 8/2005 | Juestel et al. | 445/7 |
| 2007/0103046 | A1 | 5/2007 | Tinwell | 313/143 |
| 2012/0015578 | A1 | 1/2012 | Nakayama et al. | 445/7 |
| 2012/0019120 | A1 | 1/2012 | Nakayama et al. | 313/141 |

FOREIGN PATENT DOCUMENTS

| | | | |
|---|---|---|---|
| JP | 11-354251 | 12/1999 | H01T 13/32 |
| JP | 2002-50448 | 2/2002 | H01T 13/20 |
| JP | 2004-517459 | 6/2004 | H01T 21/02 |
| JP | 3820756 | 6/2006 | H01T 13/20 |
| JP | 2007-87969 | 4/2007 | H01T 13/20 |
| JP | 4075137 | 2/2008 | H01T 13/32 |
| JP | 4092889 | 3/2008 | H01T 13/16 |
| JP | 2009-084691 | 3/2009 | H01T 21/02 |
| JP | 2010-238498 | 10/2010 | H01T 13/20 |

OTHER PUBLICATIONS

European Search Report issued in corresponding European patent application dated Dec. 19, 2013 (in English); 9 pages.

FIG. 4(A)
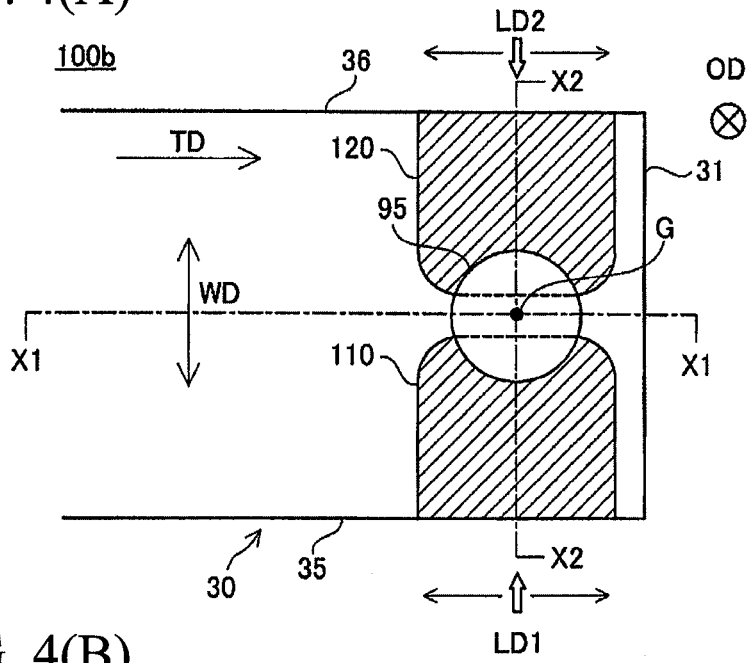
FIG. 4(B)
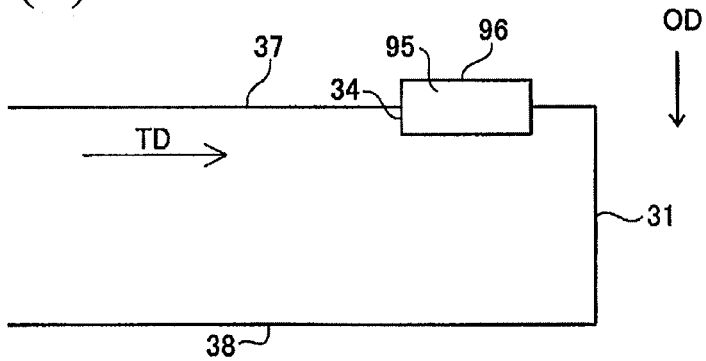
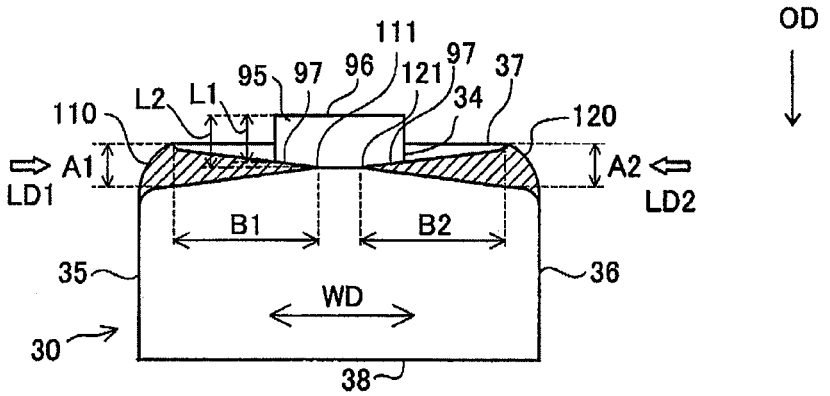
FIG. 4(C)

FIG. 5(A)
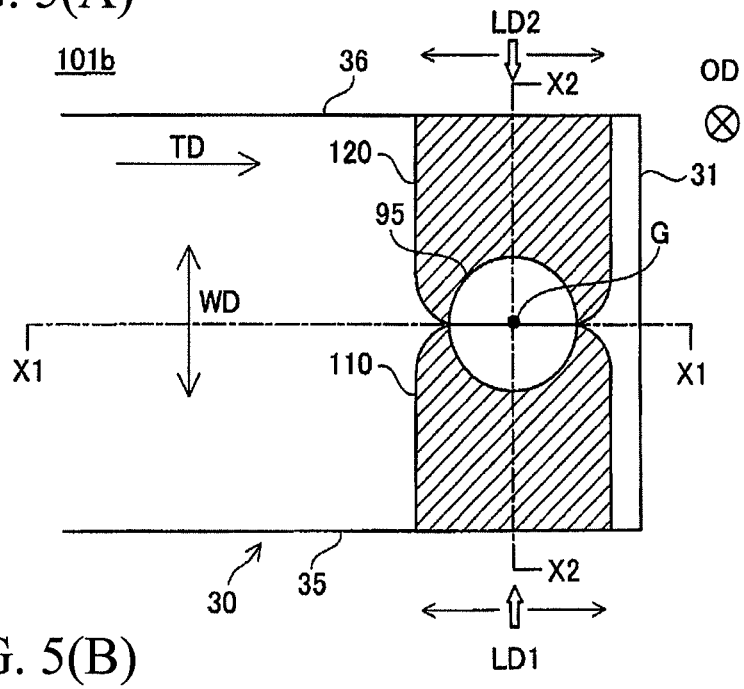
FIG. 5(B)
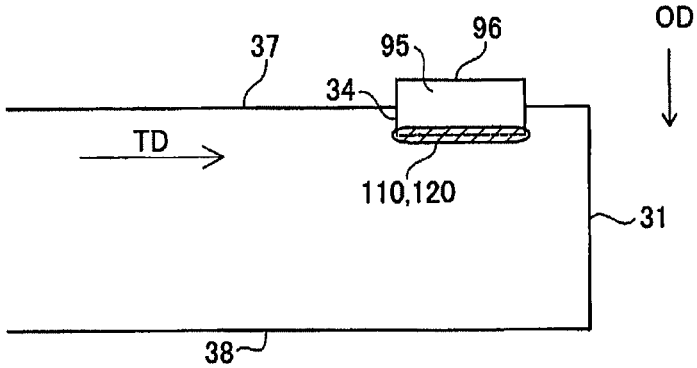
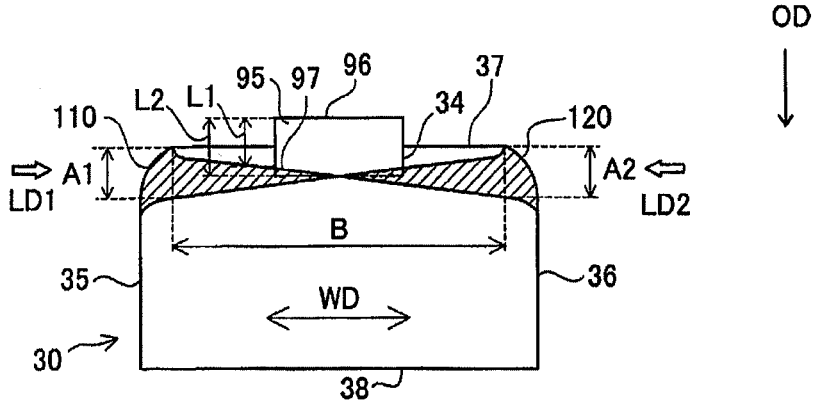
FIG. 5(C)

FIG. 6(A)
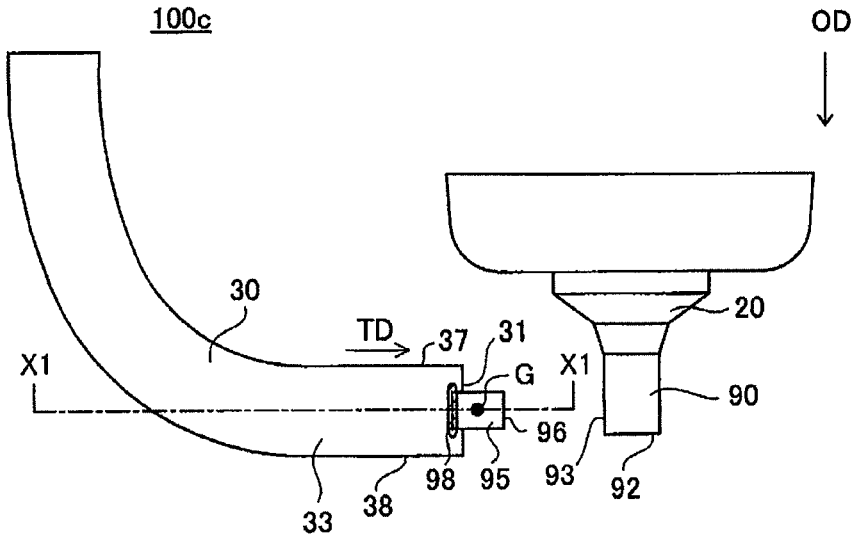
FIG. 6(B)
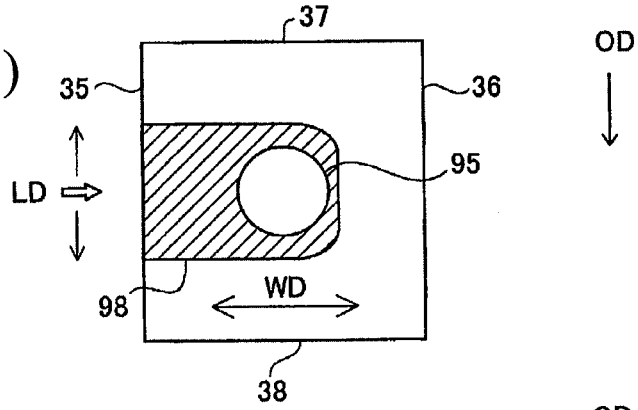
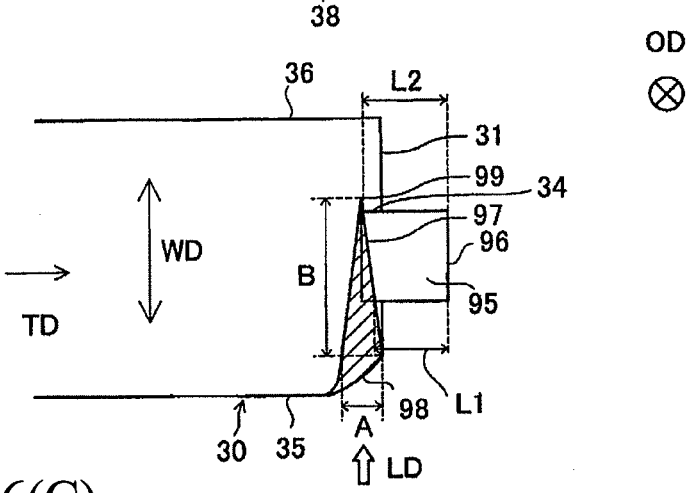
FIG. 6(C)

FIG. 8(A)
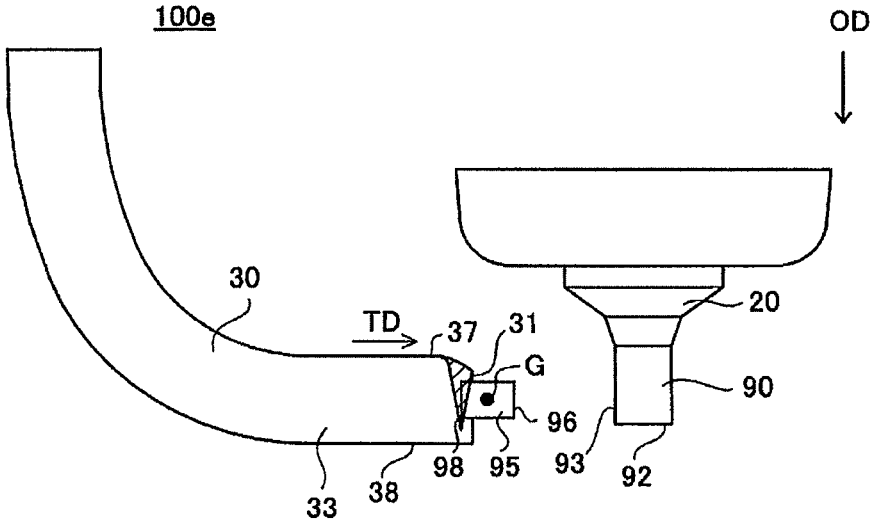
FIG. 8(B)
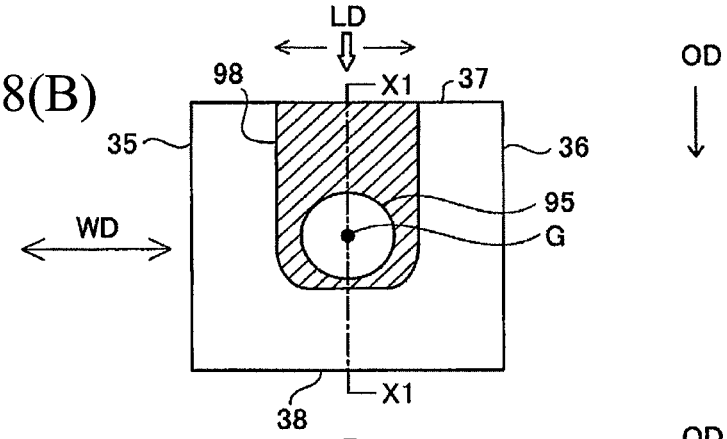
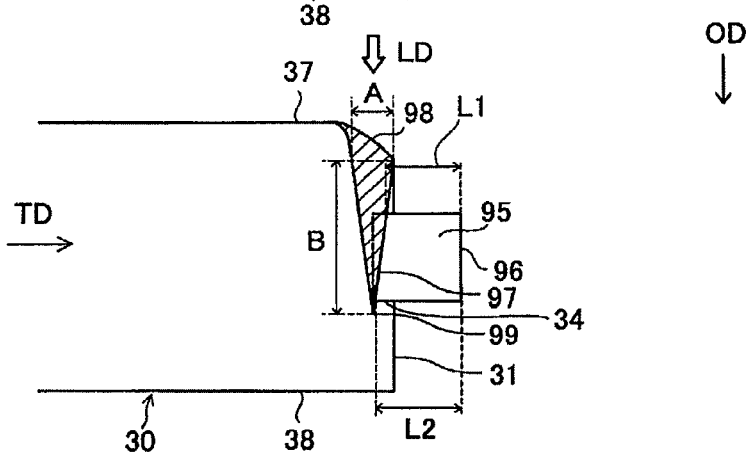
FIG. 8(C)

FIG. 9(A)
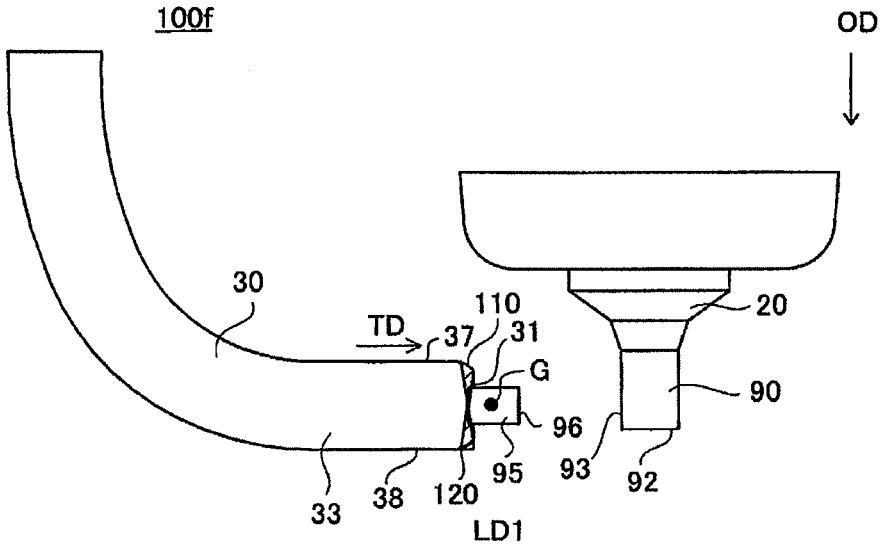
FIG. 9(B)
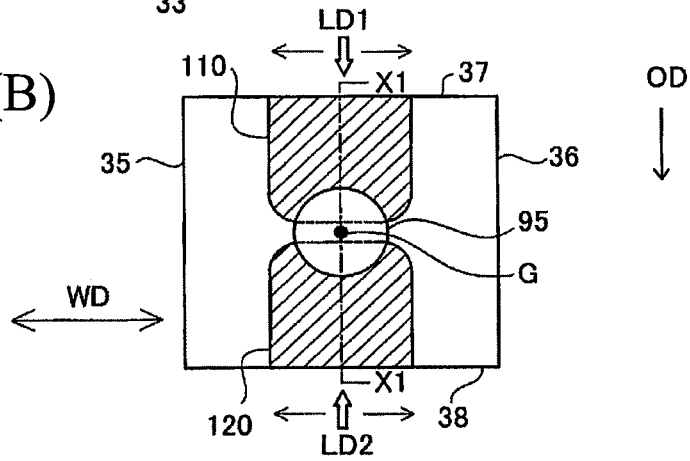
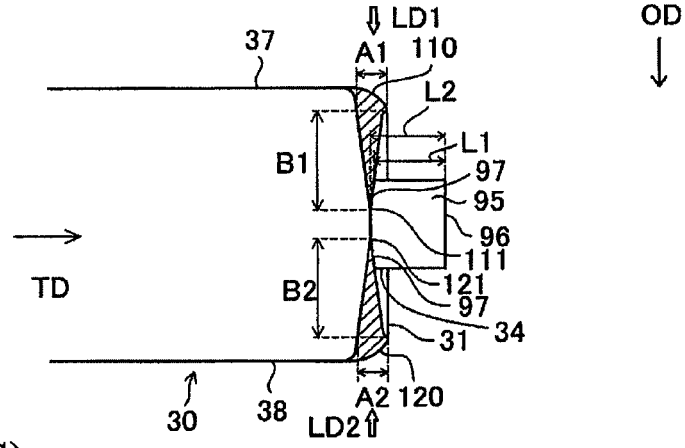
FIG. 9(C)

FIG. 10(A)
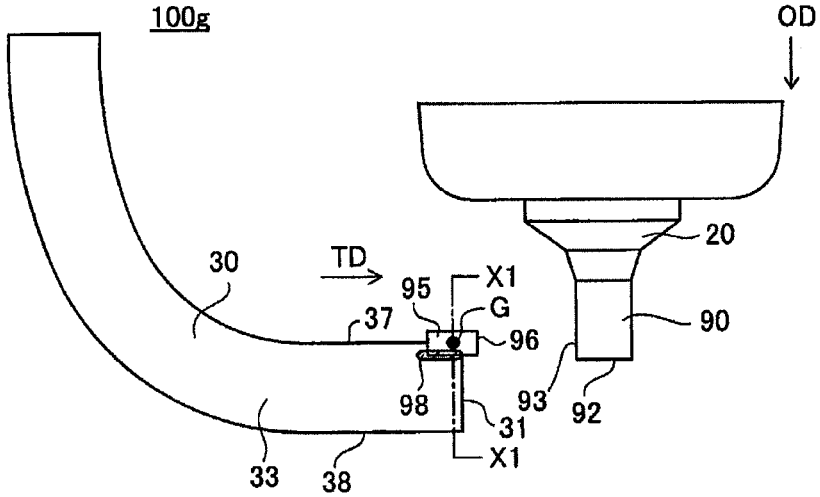
FIG. 10(B)
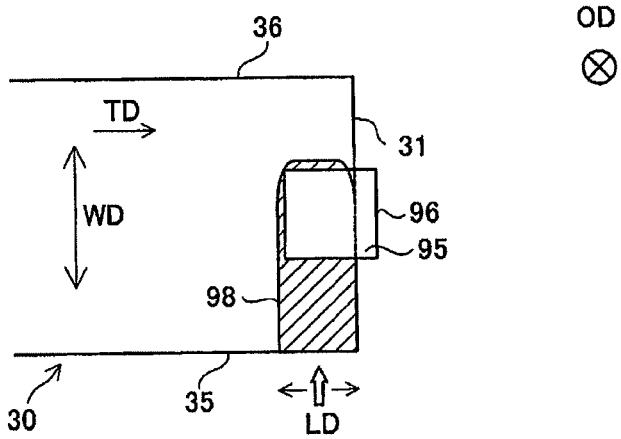
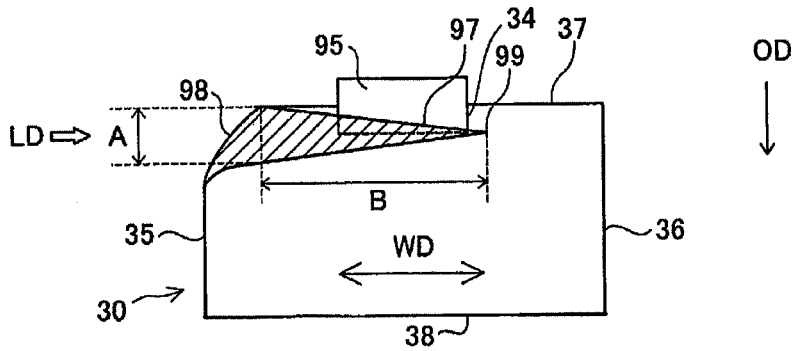
FIG. 10(C)

FIG. 11(A)
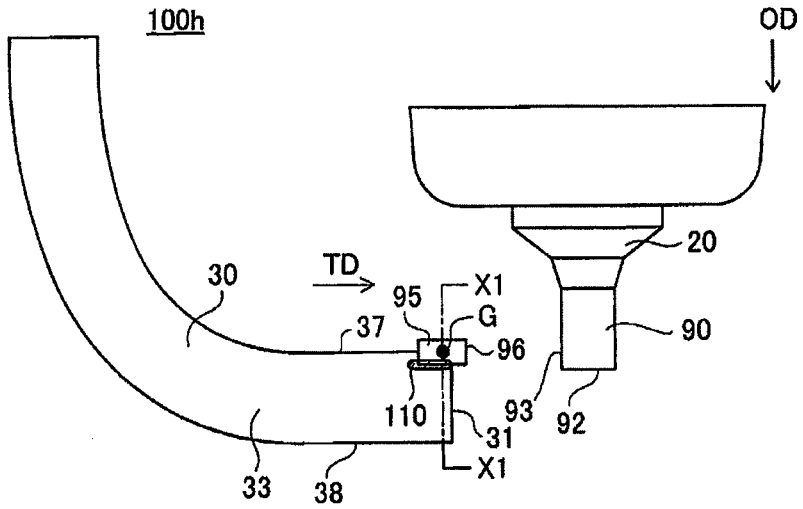
FIG. 11(B)
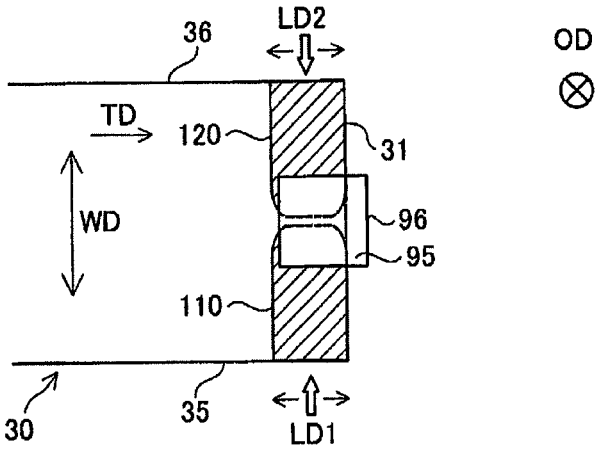
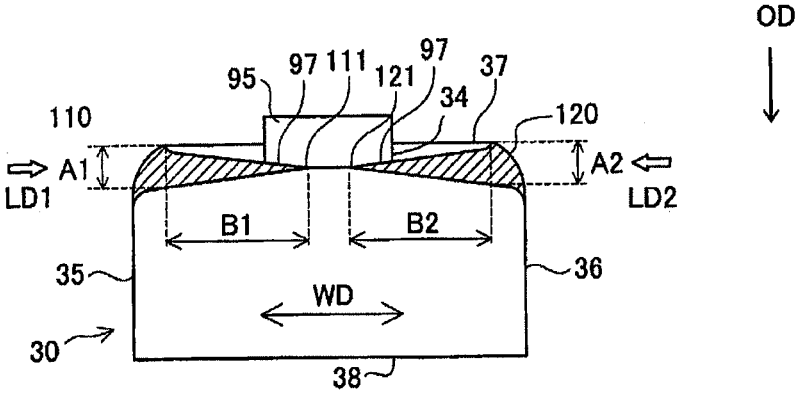
FIG. 11(C)

FIG. 12(A)
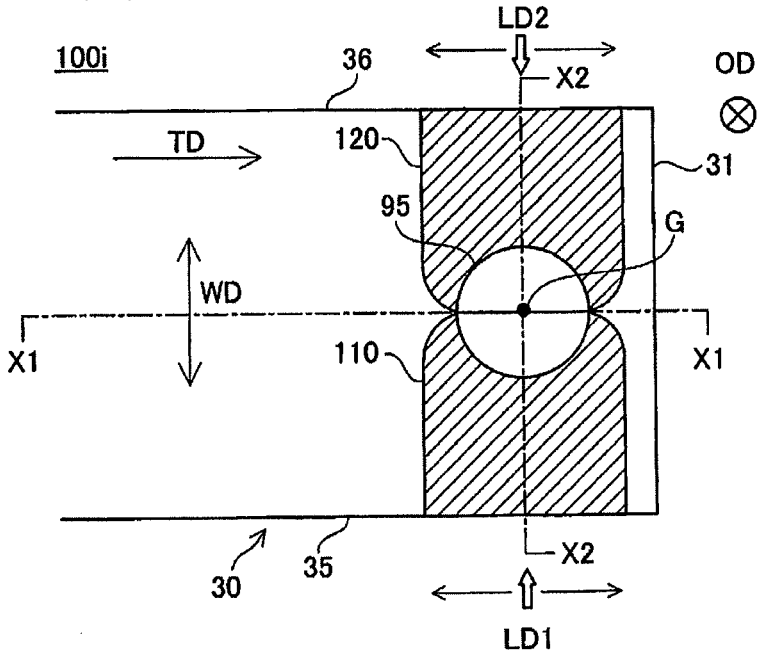
FIG. 12(B)
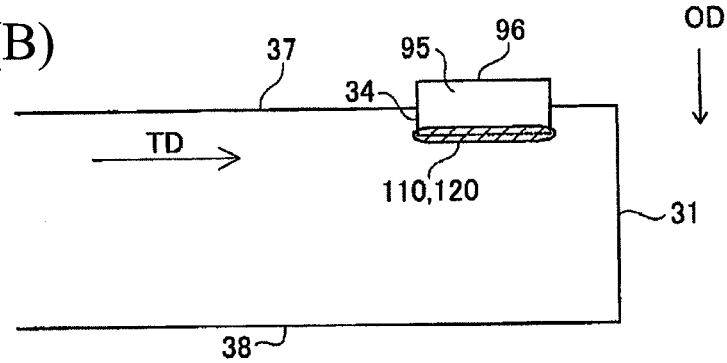
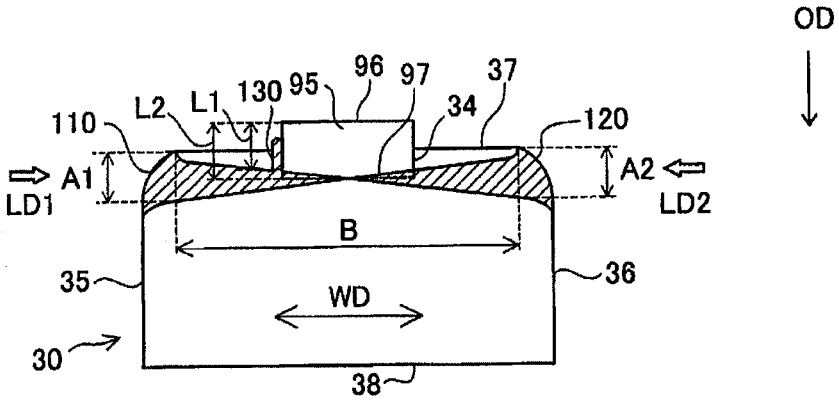
FIG. 12(C)

FIG. 17(A)
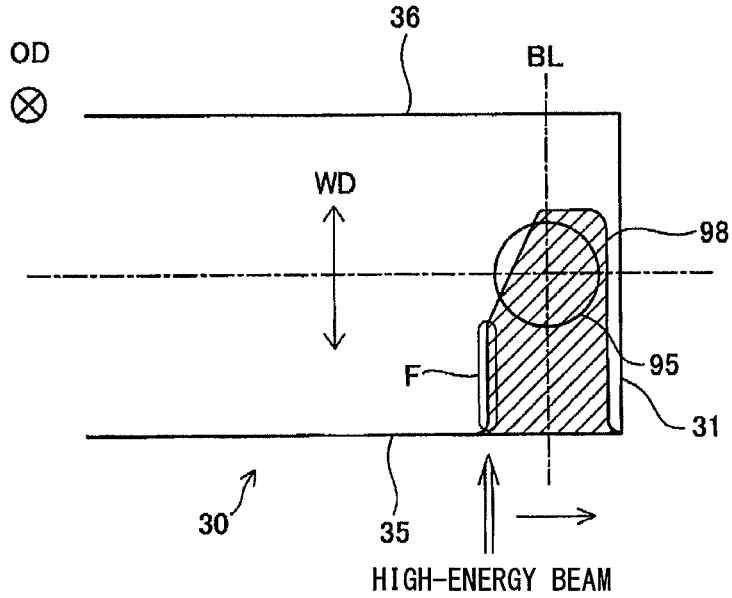
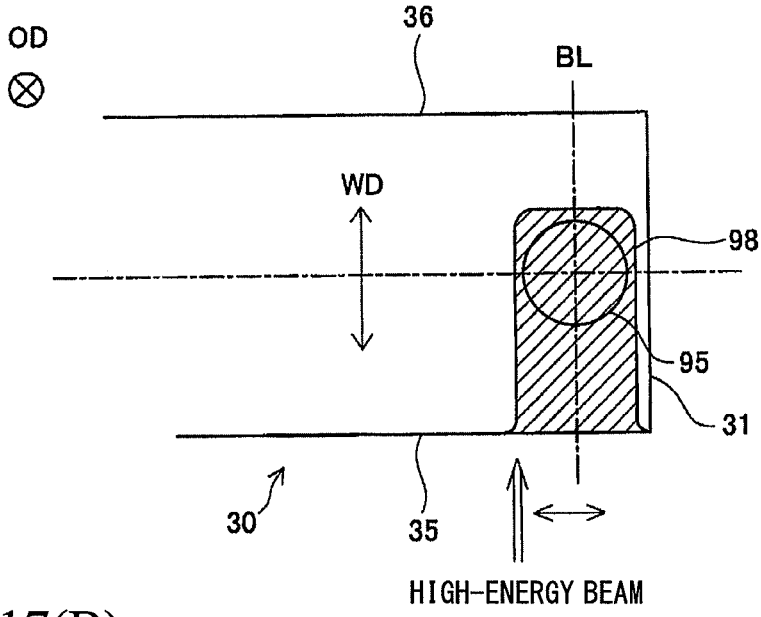
FIG. 17(B)

FIG. 18(A)
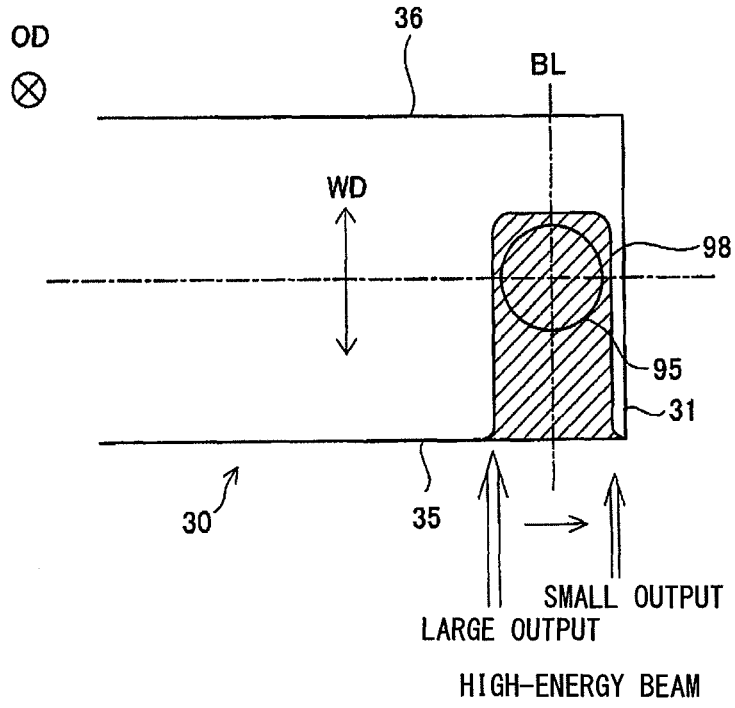
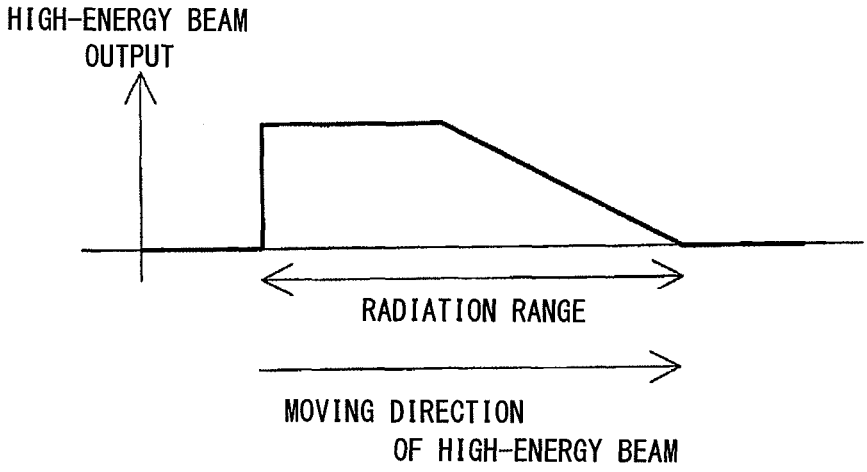
FIG. 18(B)

FIG. 19(A)
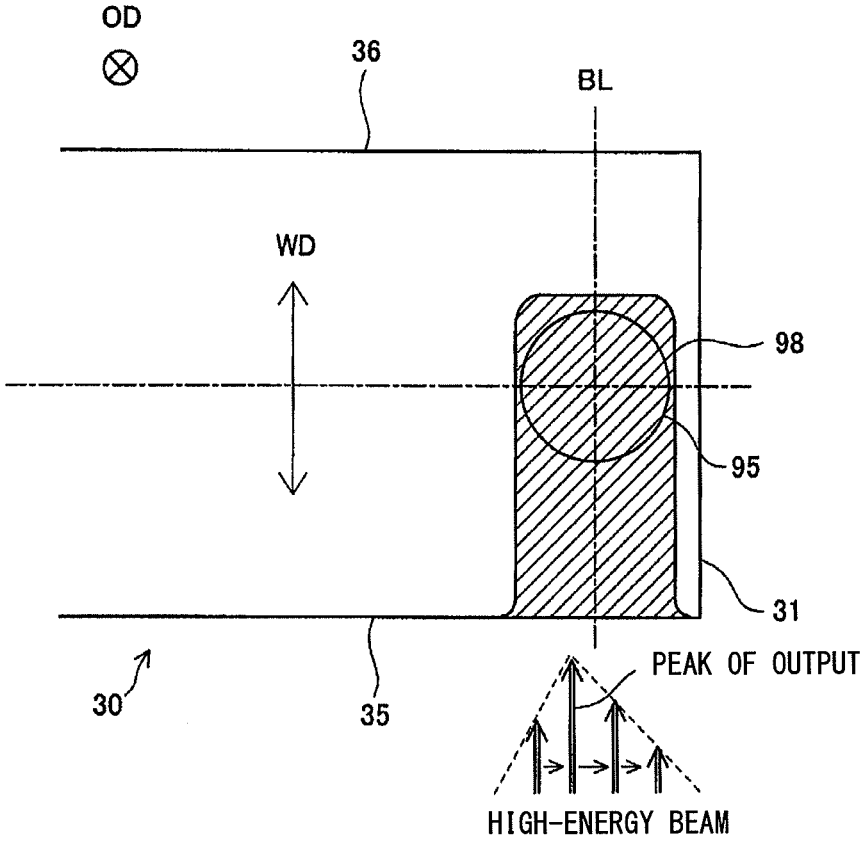
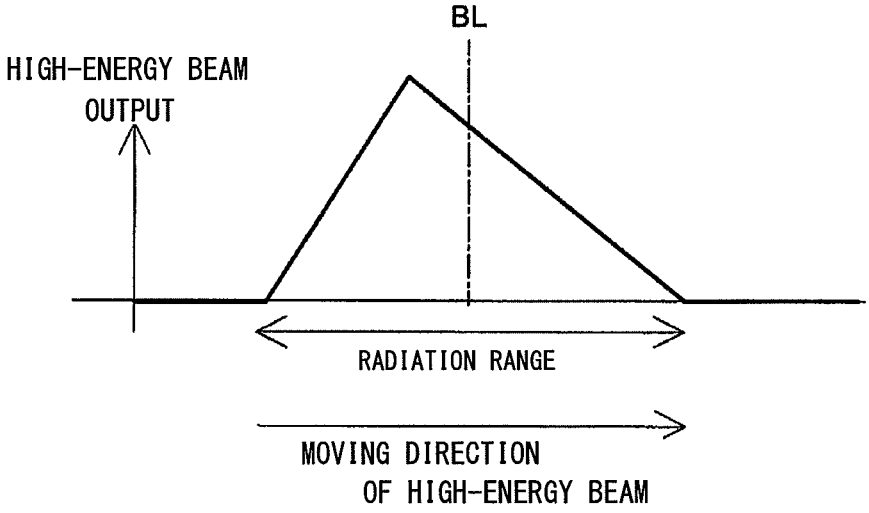
FIG. 19(B)

SPARK PLUG WITH IMPROVED RESISTANCE TO SPARK-INDUCED EROSION OF THE GROUND ELECTRODE TIP

FIELD OF THE INVENTION

The present invention relates to a spark plug.

BACKGROUND OF THE INVENTION

Conventionally known methods of joining a noble metal tip to a ground electrode of a spark plug are disclosed in, for example, PCT Application Laid-Open No. 2004-517459 and US Patent Application Publication No. 2007/0103046.

According to the method disclosed in PCT Application Laid-Open No. 2004-517459, a noble metal tip is completely melted and joined to a ground electrode. This method can increase the welding strength between the ground electrode and the noble metal tip, but involves a problem of deterioration in spark endurance, since the discharge surface of the noble metal tip contains components of a ground electrode base metal as a result of fusion.

Also, according to the method disclosed in US Patent Application Publication No. 2007/0103046, a peripheral portion of a noble metal tip is melted, thereby joining the noble metal tip to a ground electrode. This method, however, involves the following problem: the welding strength between the ground electrode and a central portion of the noble metal tip is weak, and cracking may be generated in the noble metal tip or a fusion zone, potentially resulting in separation of the noble metal tip.

Also, a method which uses resistance welding is known for joining a noble metal tip to a ground electrode. This method, however, involves the following problem: since the layer of a fusion zone at the interface between the ground electrode and the noble metal tip is thin, welding strength fails to cope with a severer working environment of a spark plug than before, such as an increase in temperature within a cylinder, in association with recent tendency toward higher engine outputs, potentially resulting in separation of the noble metal tip.

SUMMARY OF THE INVENTION

The present invention has been conceived to solve the conventional problems mentioned above, and an object of the invention is to provide a technique for improving welding strength between a ground electrode and a noble metal tip.

To solve, at least partially, the above problems, the present invention can be embodied in the following modes or application examples.

Application Example 1

In accordance with a first embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided at a position on the ground electrode which faces a forward end surface of the center electrode, and adapted to form a spark discharge gap in cooperation with the inner end surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone has such a shape as to extend from a side surface of the ground electrode, a thickness of the fusion zone along the axial direction gradually reduces along a direction directed away from the side surface of the ground electrode, and a relational expression $1.3 \leq B/A$ is satisfied, where A is a greatest thickness of the fusion zone along the axial direction, and B is a length from a portion having the greatest thickness of the fusion zone to an inner end of the fusion zone.

According to the thus-configured spark plug, the generation of oxide scale can be restrained, whereby welding strength between the noble metal tip and the ground electrode can be improved.

Application Example 2

In accordance with a second embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided at a position on the ground electrode which faces a forward end surface of the center electrode, and adapted to form a spark discharge gap in cooperation with the forward end surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the axial direction gradually reduces along a direction directed away from the first side surface of the ground electrode, a thickness of the second fusion zone along the axial direction gradually reduces along a direction directed away from the second side surface of the ground electrode, and a relational expression 1.3≤B/A is satisfied, where A is a total of A1 and A2, A1 being a greatest thickness of the first fusion zone along the axial direction, and A2 being a greatest thickness of the second fusion zone along the axial direction, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

According to the thus-configured spark plug, stress in the ground electrode can be appropriately mitigated; therefore, the generation of oxide scale can be restrained, whereby welding strength between the noble metal tip and the ground electrode can be improved. As a result, separation of the noble metal tip from the ground electrode can be restrained.

Application Example 3

In accordance with a third embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a distal end surface of the ground electrode and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to the axial direction, the fusion zone has such a shape as to extend from a side surface of the ground electrode, a thickness of the fusion zone along the longitudinal direction of the ground electrode gradually reduces along a direction directed away from the side surface of the ground electrode, and a relational expression 1.3≤B/A is satisfied, where A is a greatest thickness of the fusion zone along the longitudinal direction of the ground electrode, and B is a length from a portion having the greatest thickness of the fusion zone to an inner end of the fusion zone.

According to the thus-configured spark plug, the generation of oxide scale can be restrained, whereby welding strength between the noble metal tip and the ground electrode can be improved.

Application Example 4

In accordance with a fourth embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a distal end surface of the ground electrode and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to the axial direction, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the longitudinal direction of the ground electrode gradually reduces along a direction directed away from the first side surface of the ground electrode, a thickness of the second fusion zone along the longitudinal direction of the ground electrode gradually reduces along a direction directed away from the second side surface of the ground electrode, and a relational expression 1.3≤B/A is satisfied, where A is a total of A1 and A2, A1 being a greatest thickness of the first fusion zone along the longitudinal direction of the ground electrode, and A2 being a greatest thickness of the second fusion zone along the longitudinal direction of the ground electrode, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

According to the thus-configured spark plug, the generation of oxide scale can be restrained, whereby welding strength between the noble metal tip and the ground electrode can be improved.

Application Example 5

In accordance with a fifth embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a distal end surface of the ground electrode and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to a width direction of the ground electrode, the fusion zone has such a shape as to extend from an inner side surface of the ground electrode, a thickness of the fusion zone along the longitudinal direction of the ground electrode gradually reduces along a direction directed away from the inner side surface of the ground electrode, and a relational expression $1.3 \leq B/A$ is satisfied, where A is a greatest thickness of the fusion zone along the longitudinal direction of the ground electrode, and B is a length from a portion having the greatest thickness of the fusion zone to an inner end of the fusion zone.

According to the thus-configured spark plug, the generation of oxide scale can be restrained, whereby welding strength between the noble metal tip and the ground electrode can be improved.

Application Example 6

In accordance with a sixth embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a distal end surface of the ground electrode and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to a width direction of the ground electrode, the fusion zone includes a first fusion zone having such a shape as to extend from an inner side surface of the ground electrode, and a second fusion zone having such a shape as to extend from an outer side surface opposite the inner side surface of the ground electrode, a thickness of the first fusion zone along the longitudinal direction of the ground electrode gradually reduces along a direction directed away from the inner side surface of the ground electrode, a thickness of the second fusion zone along the longitudinal direction of the ground electrode gradually reduces along a direction directed away from the outer side surface of the ground electrode, and a relational expression $1.3 \leq B/A$ is satisfied, where A is a total of A1 and A2, A1 being a greatest thickness of the first fusion zone along the longitudinal direction of the ground electrode, and A2 being a greatest thickness of the second fusion zone along the longitudinal direction of the ground electrode, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

According to the thus-configured spark plug, the generation of oxide scale can be restrained, whereby welding strength between the noble metal tip and the ground electrode can be improved.

Application Example 7

In accordance with a seventh embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a surface of the ground electrode perpendicular to the axial direction, partially projecting from a distal end surface of the ground electrode, and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone has such a shape as to extend from a side surface of the ground electrode, a thickness of the fusion zone along the axial direction gradually reduces along a direction directed away from the side surface of the ground electrode, and a relational expression $1.3 \leq B/A$ is satisfied, where A is a greatest thickness of the fusion zone along the axial direction, and B is a length from a portion having the greatest thickness of the fusion zone to an inner end of the fusion zone.

According to the thus-configured spark plug, the generation of oxide scale can be restrained, whereby welding strength between the noble metal tip and the ground electrode can be improved.

Application Example 8

In accordance with an eighth embodiment of the present invention, there is provided a spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode; and a noble metal tip provided on a surface of the ground electrode perpendicular to the axial direction, partially projecting from a distal end surface of the ground electrode, and adapted to form a spark discharge gap in cooperation with a side surface of the center electrode;

the spark plug being characterized in that:

a fusion zone where the ground electrode and the noble metal tip are fused together is formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the axial direction gradually reduces along a direction directed away from the first side surface of the ground electrode, a thickness of the second fusion zone along the axial direction gradually reduces along a direction directed away from the second side surface of the ground electrode, and a relational expression $1.3 \leq B/A$ is satisfied, where A is a total of A1 and A2, A1 being a greatest thickness of the first fusion zone along the axial direction, and A2 being a greatest thickness of the second fusion zone along the axial direction, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

According to the thus-configured spark plug, the generation of oxide scale can be restrained, whereby welding strength between the noble metal tip and the ground electrode can be improved.

Application Example 9

In accordance with a ninth embodiment of the present invention, there is provided a spark plug as described above in application examples 1 to 6, wherein the fusion zone is not formed in a discharge surface of the noble metal tip which forms the spark discharge gap in cooperation with the center electrode.

Since the noble tip is superior to the fusion zone in resistance to spark-induced erosion, the thus-configured spark plug can exhibit improved resistance to spark-induced erosion.

Application Example 10

In accordance with a tenth embodiment of the present invention, there is provided a spark plug as described above in application examples 1 to 6 and 9, wherein a relational expression $L2-L1 \leq 0.3$ mm is satisfied, where L1 is a length from a discharge surface of the noble metal tip which faces the center electrode, to a shallowest portion of the fusion zone, and L2 is a length from the discharge surface to a deepest portion of the fusion zone.

According to the thus-configured spark plug, an increase in discharge gap in the course of use of the spark plug can be restrained, and durability of the noble metal tip can be further enhanced.

Application Example 11

In accordance with an eleventh embodiment of the present invention, there is provided a spark plug as described above in application examples 1 to 6, 9, and 10, wherein, as viewed on the section, half or more of an interfacial boundary between the fusion zone and the noble metal tip forms an angle of 0 degree to 10 degrees with respect to the discharge surface of the noble metal tip which faces the center electrode.

According to the thus-configured spark plug, an unfused portion of the noble metal tip increases in volume, whereby resistance to spark-induced erosion can be enhanced.

Application Example 12

In accordance with a twelfth embodiment of the present invention, there is provided a spark plug as described above in application examples 1 to 11, wherein:

a portion of the noble metal tip is embedded in a groove portion formed in the ground electrode, and as viewed on the section, a fusion zone where the groove portion and the noble metal tip are fused together is additionally formed at a portion perpendicular to a longitudinal direction of the fusion zone of an interfacial boundary between the groove portion and the noble metal tip.

According to the thus-configured spark plug, a wide portion of the interfacial boundary between the noble metal tip and the ground electrode is welded, whereby welding strength between the noble metal tip and the ground electrode can be enhanced.

Application Example 13

In accordance with a thirteenth embodiment of the present invention, there is provided a spark plug as described above in application examples 1 to 12, wherein the fusion zone is formed by radiating a high-energy beam from a direction parallel to an interfacial boundary between the ground electrode and the noble metal tip.

Since the high-energy beam can deeply melt an irradiated object, radiation from such a direction can form the fusion zone having an appropriate shape.

Application Example 14

In accordance with a fourteenth embodiment of the present invention, there is provided a spark plug as described above in application examples 1 to 12, wherein the fusion zone is formed by radiating a high-energy beam from a direction oblique to an interfacial boundary between the ground electrode and the noble metal tip.

Radiation from such a direction can also form the fusion zone having an appropriate shape.

Application Example 15

In accordance with a fifteenth embodiment of the present invention, there is provided a spark plug as described above in application examples 1 to 14, wherein the fusion zone is formed by irradiating an interfacial boundary between the ground electrode and the noble metal tip with a fiber laser beam or an electron beam.

Since a fiber laser beam or an electron beam used as a high-energy beam can deeply melt the interfacial boundary between the ground electrode and the noble metal tip, the ground electrode and the noble metal tip can be strongly joined to each other.

The present invention can be implemented in various forms. For example, the present invention can be implemented in a method of manufacturing a spark plug, an apparatus for manufacturing a spark plug, and a system of manufacturing a spark plug.

BRIEF DESCRIPTION OF THE DRAWINGS

FIGS. 4(A)-4(C) are sets of explanatory views showing, on an enlarged scale, the distal end portion 33 and its vicinity of the ground electrode 30 in a spark plug 100*b* according to a second embodiment of the present invention.

FIGS. 5(A)-5(C) are sets of explanatory views showing, on an enlarged scale, the distal end portion 33 and its vicinity of the ground electrode 30 in a spark plug 101*b* according to a modification of the second embodiment.

FIGS. 6(A)-6(C) are sets of explanatory views showing, on an enlarged scale, the distal end portion 33 and its vicinity of the ground electrode 30 in a spark plug 100*c* according to a third embodiment of the present invention.

FIGS. 8(A)-8(C) are sets of explanatory views showing, on an enlarged scale, the distal end portion 33 and its vicinity of the ground electrode 30 in a spark plug 100*e* according to a fifth embodiment of the present invention.

FIGS. 9(A)-9(C) are sets of explanatory views showing, on an enlarged scale, the distal end portion 33 and its vicinity of the ground electrode 30 in a spark plug 100*f* according to a sixth embodiment of the present invention.

FIGS. 10(A)-10(C) are sets of explanatory views showing, on an enlarged scale, the distal end portion 33 and its vicinity of the ground electrode 30 in a spark plug 100*g* according to a seventh embodiment of the present invention.

FIGS. 11(A)-11(C) are sets of explanatory views showing, on an enlarged scale, the distal end portion 33 and its vicinity of the ground electrode 30 in a spark plug 100*h* according to an eighth embodiment of the present invention.

FIGS. 12(A)-12(C) are sets of explanatory views showing, on an enlarged scale, the distal end portion 33 and its vicinity of the ground electrode 30 in a spark plug 100*i* according to a ninth embodiment of the present invention.

FIGS. 17(A)-17(B) are a pair of explanatory views showing an example process of formation of a fusion zone 98.

FIGS. 18(A)-18(B) are explanatory views and diagrams showing another example process of formation of the fusion zone 98.

FIGS. 19(A)-19(B) are explanatory views and diagrams showing a further example process of formation of the fusion zone 98.

DETAILED DESCRIPTION OF PREFERRED EMBODIMENTS

Embodiments of a spark plug according to a mode for carrying out the present invention will next be described in the following order.

A. First embodiment
A1. Structure of spark plug
A2. Shapes and dimensions of constitutional features
B to I. Second to ninth embodiments
J. Example experiment on oxide scale
K. Example experiment on amount of increase in gap GA
L. Modifications
M. Method of manufacturing spark plug

A. First Embodiment

A1. Structure of Spark Plug

Figure 1:
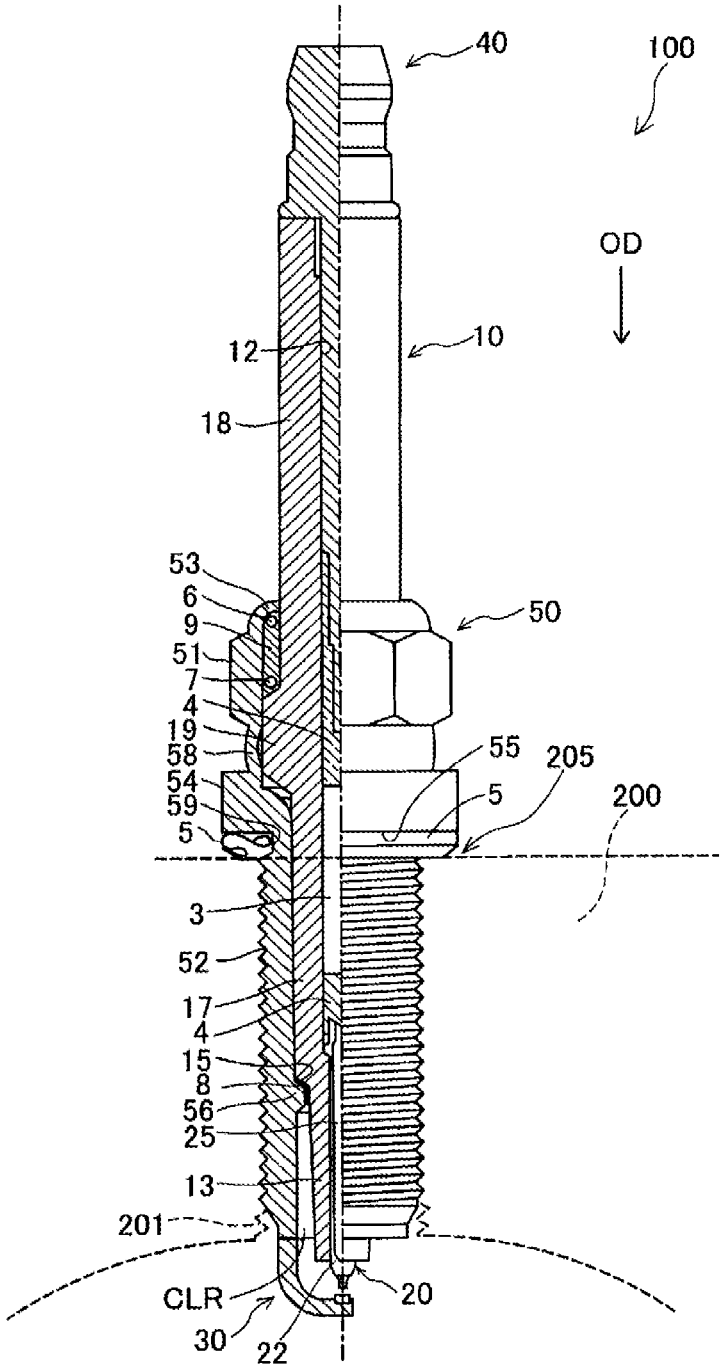
FIG. 1 is a partially sectional view showing a spark plug 100 according to an embodiment of the present invention.

FIG. 1 is a partially sectional view showing a spark plug 100 according to an embodiment of the present invention. In the following description, an axial direction OD of the spark plug 100 in FIG. 1 is referred to as the vertical direction, and the lower side of the spark plug 100 in FIG. 1 is referred to as the forward side of the spark plug 100, and the upper side as the rear side.

The spark plug 100 includes a ceramic insulator 10, a metallic shell 50, a center electrode 20, a ground electrode 30, and a metal terminal 40. The center electrode 20 is held while extending in the ceramic insulator 10 in the axial direction OD. The ceramic insulator 10 functions as an insulator, and the metallic shell 50 holds the ceramic insulator 10. The metal terminal 40 is provided at a rear end portion of the ceramic insulator 10. The configuration of the center electrode 20 and the ground electrode 30 will be described in detail later with reference to FIG. 2.

The ceramic insulator 10 is formed from alumina, etc. through firing and has a tubular shape such that an axial bore 12 extends therethrough coaxially along the axial direction OD. The ceramic insulator 10 has a flange portion 19 having the largest outside diameter. The flange portion 19 is located substantially at the center with respect to the axial direction OD. A rear trunk portion 18 is located rearward (upward in FIG. 1) of the flange portion 19. The ceramic insulator 10 also has a forward trunk portion 17 smaller in outside diameter than the rear trunk portion 18 that is located forward (downward in FIG. 1) of the flange portion 19. A leg portion 13 that is smaller in outside diameter than the forward trunk portion 17 is located forward of the forward trunk portion 17. The leg portion 13 is reduced in diameter in the forward direction and is exposed to a combustion chamber of an internal combustion engine when the spark plug 100 is mounted to an engine head 200 of the engine. A stepped portion 15 is formed between the leg portion 13 and the forward trunk portion 17.

The metallic shell 50 is a cylindrical metallic member formed from low-carbon steel and is adapted to fix the spark plug 100 to the engine head 200 of the internal combustion engine. The metallic shell 50 holds the ceramic insulator 10 therein and surrounds a region of the ceramic insulator 10 extending from a subportion of the rear trunk portion 18 to the leg portion 13.

The metallic shell 50 has a tool engagement portion 51 and a mounting threaded portion 52. The tool engagement portion 51 allows a spark plug wrench (not shown) to be fitted thereto. The mounting threaded portion 52 of the metallic shell 50 has threads formed thereon and is threadingly engaged with a mounting threaded hole 201 of the engine head 200 provided at an upper portion of the internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral-portion-around-opening 205 of the mounting threaded hole 201. The deformation of the gasket 5 provides a seal between the spark plug 100 and the engine head 200, thereby preventing gas leakage from inside the engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6 and 7 are disposed between an outer circumferential surface of the rear trunk portion 18 of the ceramic insulator 10 and an inner circumferential surface of the metallic shell 50 extending from the tool engagement portion 51 to the crimp portion 53. Furthermore, a space between the two ring members 6 and 7 is filled with a powder of talc 9. When the crimp portion 53 is crimped in an inwardly bending manner, the ceramic insulator 10 is pressed forward within the metallic shell 50 via the ring members 6 and 7 and the talc 9. Accordingly, the stepped portion 15 of the ceramic insulator 10 is supported by a stepped portion 56 formed on the inner circumference of the metallic shell 50, whereby the metallic shell 50 and the ceramic insulator 10 are united together. At this time, gastightness between the metallic shell 50 and the ceramic insulator 10 is maintained by means of an annular sheet packing 8 which intervenes between the stepped portion 15 of the ceramic insulator 10 and the stepped portion 56 of the metallic shell 50, thereby preventing outflow of combustion gas. The buckle portion 58 is designed to be deformed outwardly in association with application of compressive force in a crimping process, thereby contributing toward increasing the stroke of compression of the talc 9 and thus enhancing gastightness within the metallic shell 50. A clearance CLR having a predetermined dimension is provided between the ceramic insulator 10 and a portion of the metallic shell 50 located forward of the stepped portion 56.

Figure 2:
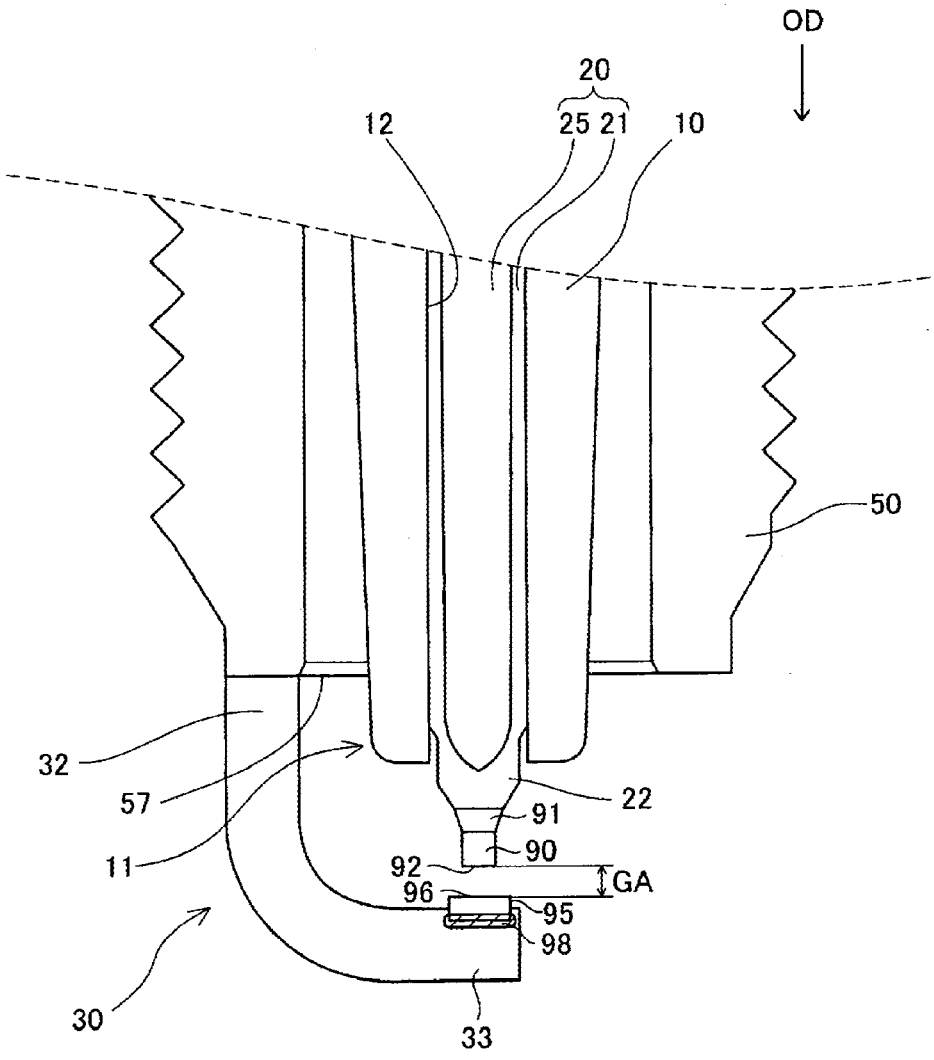
FIG. 2 is an enlarged view showing a forward end portion 22 of a center electrode 20 and its periphery of the spark plug 100.

FIG. 2 is an enlarged view showing a forward end portion 22 of the center electrode 20 and its periphery of the spark plug 100. The center electrode 20 is a rodlike electrode having a structure in which a core 25 is embedded within an electrode base metal 21. The electrode base metal 21 is formed from nickel or an alloy which contains Ni as a main component, such as INCONEL (trade name) 600 or 601. The core 25 is formed from copper or an alloy which contains Cu as a main component, copper and the alloy being superior in thermal conductivity to the electrode base metal 21. Usually, the center electrode 20 is fabricated as follows: the core 25 is disposed within the electrode base metal 21 which is formed into a closed-bottomed tubular shape, and the resultant assembly is drawn by extrusion from the bottom side. The core 25 is formed such that, while a trunk portion has a substantially fixed outside diameter, a forward end portion is tapered. The center electrode 20 extends rearward through the axial bore 12 and is electrically connected to the metal terminal 40 (FIG. 1) via a seal body 4 and a ceramic resistor 3 (FIG. 1). A high-voltage cable (not shown) is connected to the metal terminal 40 via a plug cap (not shown) for applying high voltage to the metal terminal 40.

The forward end portion 22 of the center electrode 20 projects from a forward end portion 11 of the ceramic insulator 10. A center electrode tip 90 is joined to the forward end surface of the forward end portion 22 of the center electrode 20. The center electrode tip 90 has a substantially circular columnar shape extending in the axial direction OD and is formed from a noble metal having high melting point in order to improve resistance to spark-induced erosion. The center electrode tip 90 is formed from, for example, iridium (Ir) or an Ir alloy which contains Ir as a main component and an additive of one or more elements selected from among platinum (Pt), rhodium (Rh), ruthenium (Ru), palladium (Pd), and rhenium (Re).

The ground electrode 30 is formed from a metal having high corrosion resistance; for example, an Ni alloy, such as INCONEL (trade name) 600 or 601. A proximal end portion 32 of the ground electrode 30 is joined to a forward end portion 57 of the metallic shell 50 by welding. Also, the ground electrode 30 is bent such that a distal end portion 33 thereof faces the forward end portion 22 of the center electrode 20. More specifically, the distal end portion 33 of the ground electrode 30 faces a forward end surface 92 of the center electrode tip 90.

A ground electrode tip 95 is joined to the ground electrode 30 via a fusion zone 98, at a position which faces the forward end surface 92 of the center electrode tip 90. A discharge surface 96 of the ground electrode tip 95 faces the forward end surface 92 of the center electrode tip 90, whereby a gap GA across which spark discharge is performed is formed between the discharge surface 96 of the ground electrode tip 95 and the forward end surface 92 of the center electrode tip 90. Similar to the center electrode tip 90, the ground electrode tip 95 is formed from a noble metal having high melting point and contains, for example, one or more elements selected from among Ir, Pt, Rh, Ru, Pd, and Re. By this way, resistance to spark-induced erosion of the ground electrode tip 95 can be improved.

A2. Shapes and dimensions of constitutional features

Figure 3A:
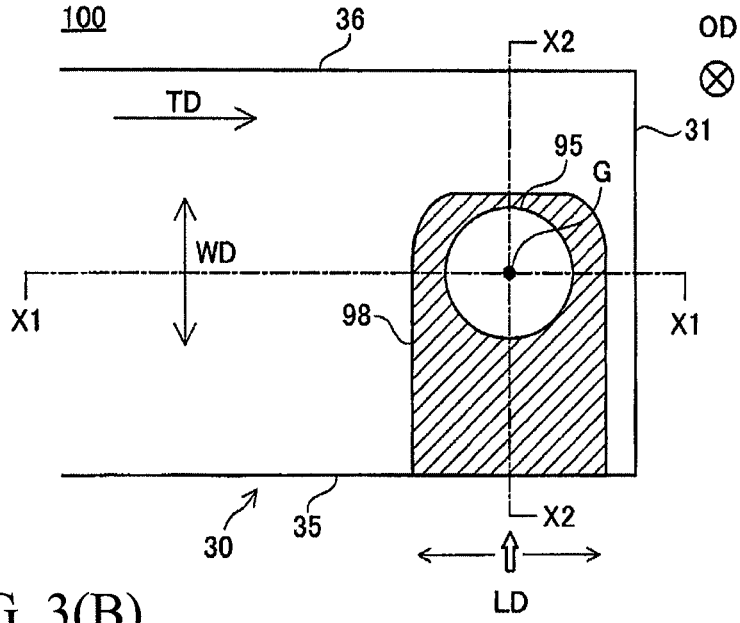
FIGS. 3(A)-3(C) are sets of explanatory views showing, on an enlarged scale, a distal end portion 33 and its vicinity of a ground electrode 30.
Figure 3B:
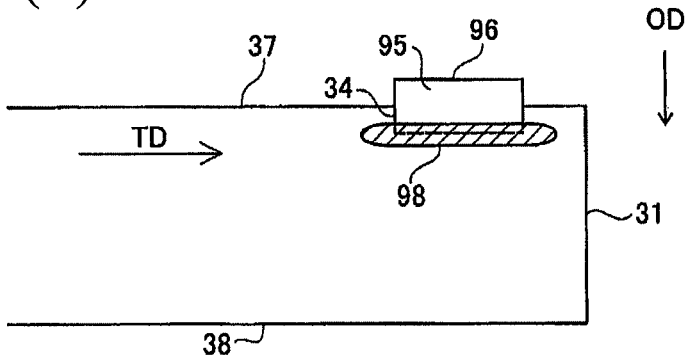
Figure 3C:
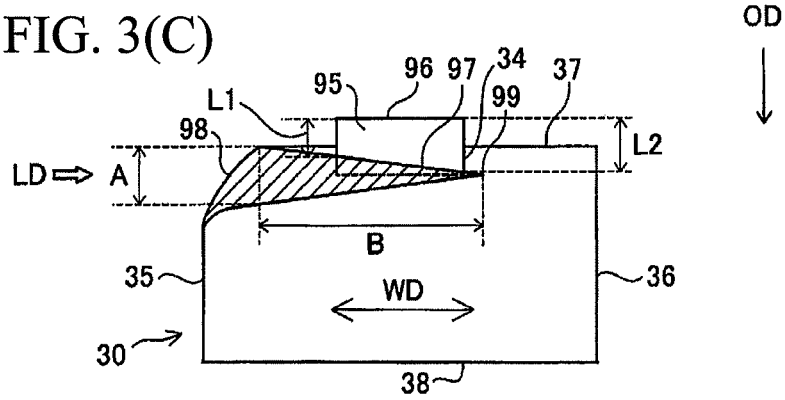

FIGS. 3(A)-(3B) are sets of explanatory views showing, on an enlarged scale, the distal end portion 33 and its vicinity of the ground electrode 30. FIG. 3(A) is a view showing the ground electrode 30 as viewed from the axial direction OD. FIG. 3(B) is a sectional view taken along line X1-X1 of FIG. 3(A). FIG. 3(C) is a sectional view taken along line X2-X2 of FIG. 3(A). In other words, FIG. 3(C) shows a section which passes through the center of gravity G of the ground electrode tip 95 and is perpendicular to a longitudinal direction TD of the ground electrode 30.

As shown in FIG. 3(B), the distal end portion 33 of the ground electrode 30 has a groove portion 34 having the same shape as that of the bottom surface of the ground electrode tip 95, and the ground electrode tip 95 is embedded in the groove portion 34. The fusion zone 98 is formed in at least a portion of the interfacial region between the ground electrode tip 95 and the ground electrode 30. The fusion zone 98 is formed through fusion between a portion of the ground electrode tip 95 and a portion of the ground electrode 30, and contains components of both of the ground electrode tip 95 and the ground electrode 30. That is, the fusion zone 98 has an intermediate composition between the ground electrode 30 and the ground electrode tip 95. A broken line appears between the ground electrode tip 95 and the ground electrode 30; however, in actuality, in the fusion zone 98, the ground electrode tip 95 and the ground electrode 30 are fused together, and an outline represented by the broken line does not exist. The same also applies to the drawings referred to in the following description.

The fusion zone 98 can be formed through radiation of a high-energy beam from a direction LD substantially parallel to the boundary between the ground electrode 30 and the ground electrode tip 95 (i.e., the bottom surface of the ground electrode tip 95) (FIG. 3(C)). More specifically, the fusion zone 98 can be formed by radiating the high-energy beam while the beam is relatively moved along the longitudinal direction TD of the ground electrode 30 (FIG. 3(A)). In the present embodiment, a fiber laser beam is used as the high-energy beam for forming the fusion zone 98. However, in place of the fiber laser beam, an electron beam may be used. Since the fiber laser beam and the electron beam can deeply melt the boundary between the ground electrode 30 and the ground electrode tip 95, the ground electrode 30 and the ground electrode tip 95 can be firmly joined together. The fusion zone 98 can also be formed by radiating the high-energy beam from a direction oblique to the boundary between the ground electrode 30 and the ground electrode tip 95. After the ground electrode tip 95 is welded to the ground electrode 30, the ground electrode 30 is bent such that the ground electrode tip 95 and the center electrode 20 face each other.

Preferably, as shown in FIG. 3(A), when the fusion zone 98 is projected in the axial direction OD, the projected fusion zone 98 overlaps 70% or more of the area of the ground electrode tip 95. In the present embodiment, the fusion zone 98 overlaps 100% of the area of the ground electrode tip 95. Employment of this feature can restrain the generation of oxide scale in the vicinity of the fusion zone and thus can restrain, i.e., suppress, separation of the ground electrode tip 95 from the ground electrode 30.

Furthermore, as shown in FIG. 3(C), the fusion zone 98 has such a shape as to extend from a side surface 35 of the ground electrode 30, and the thickness of the fusion zone 98 along the axial direction OD gradually reduces along a direction directed away from the side surface 35 of the ground electrode 30. Since such a shape can appropriately disperse stress generated between the ground electrode 30 and the ground electrode tip 95, separation of the ground electrode tip 95 can be restrained (suppressed).

Also, in the sectional view of FIG. 3(C), A is the greatest thickness of the fusion zone 98 along the axial direction OD. B is the length from a portion having the greatest thickness of the fusion zone 98 to an inner end 99 of the fusion zone. In this case, preferably, the spark plug 100 satisfies the following relational expression (1).

$$1.3 \leq B/A \quad (1)$$

Employment of this feature can restrain the generation of oxide scale in the vicinity of the fusion zone 98, whereby welding strength between the ground electrode 30 and the ground electrode tip 95 can be improved. The reason for employment of the above numerical range limitation will be shown in relation to an example experiment to be described later. In the following description, B/A may also be called the fusion zone ratio.

Furthermore, preferably, as shown in FIG. 3(C), the fusion zone 98 is not formed in the discharge surface 96 of the ground electrode tip 95 which forms the spark discharge gap (the gap GA) in cooperation with the center electrode tip 90 of the center electrode 20. The reason for this is that the ground electrode tip 95 is superior to the fusion zone 98 in resistance to spark-induced erosion. Therefore, by means of the fusion zone 98 being not formed in the discharge surface 96 of the ground electrode tip 95, resistance to spark-induced erosion can be improved.

Similarly, even in other embodiments to be described below, preferably, the fusion zone is not formed in the discharge surface 96 of the ground electrode tip 95 which forms the spark discharge gap in cooperation with the center electrode tip 90 of the center electrode 20.

In the sectional view of FIG. 3(C), L1 is the length from the discharge surface 96 of the ground electrode tip 95 which faces the center electrode 20, to the shallowest portion of the fusion zone 98. L2 is the length from the discharge surface 96 of the ground electrode tip 95 to the deepest portion of the fusion zone 98. In this case, preferably, the spark plug 100 satisfies the following relational expression (2).

$$L2-L1 \leq 0.3 \text{ mm} \quad (2)$$

Employment of this feature can restrain an increase in the gap GA in the course of use of the spark plug 100 and can further improve durability of the ground electrode tip 95. Ground for specification of the above relational expression (2) will be shown in relation to an example experiment to be described later. In the following description, L2−L1 may also be called the fusion-zone level difference LA (=L2−L1).

Similarly, even in other embodiments to be described below, preferably, the fusion-zone level difference LA satisfies the above relational expression (2).

Furthermore, preferably, as shown in FIG. 3(C), half or more of an interfacial boundary 97 between the fusion zone 98 and the ground electrode tip 95 forms an angle of 0 degree to 10 degrees with respect to the discharge surface 96. Employment of this feature increases the volume of a portion free from fusion by the high-energy beam of the ground electrode tip 95; therefore, resistance to spark-induced erosion can be improved.

Similarly, even in other embodiments to be described below, preferably, half or more of the interfacial boundary 97 between the fusion zone and the ground electrode tip 95 forms an angle of 0 degree to 10 degrees with respect to the discharge surface 96.

B. Second Embodiment

FIGS. 4(A)-4(C) are sets of explanatory views showing, on an enlarged scale, the distal end portion 33 and its vicinity of the ground electrode 30 in a spark plug 100*b* according to a second embodiment of the present invention. FIGS. 4(A), 4(B), and 4(C) correspond to FIGS. 3(A), 3(B), and 3(C), respectively. The second embodiment differs from the first embodiment shown in FIG. 3 in that fusion zones 110 and 120 are formed from opposite side surfaces 35 and 36, respectively, of the ground electrode 30. Other configurational features are similar to those of the first embodiment.

The first fusion zone 110 can be formed through radiation of a high-energy beam from a direction LD1 directed toward the side surface 35 of the ground electrode 30. Similarly, the second fusion zone 120 can be formed through radiation of the high-energy beam from a direction LD2 directed toward the side surface 36 of the ground electrode 30.

Preferably, as shown in FIG. 4(A), when the fusion zones 110 and 120 are projected in the axial direction OD, the projected fusion zones 110 and 120 collectively overlap 70% or more of the area of the ground electrode tip 95. In the present embodiment, the fusion zones 110 and 120 collectively overlap 70% of the area of the ground electrode tip 95. Employment of this feature can restrain the generation of oxide scale in the vicinity of the fusion zones and thus can restrain separation of the ground electrode tip 95 from the ground electrode 30.

Also, as shown in FIG. 4(C), the first fusion zone 110 has such a shape as to extend from the side surface 35 of the ground electrode 30, and the thickness of the first fusion zone 110 along the axial direction OD gradually reduces along a direction directed away from the side surface 35. The second fusion zone 120 has such a shape as to extend from the side surface 36 opposite the side surface 35 of the ground electrode 30, and the thickness of the second fusion zone 120 along the axial direction OD gradually reduces along a direction directed away from the side surface 36 of the ground electrode 30.

Employment of this feature can restrain the generation of oxide scale and thus can restrain separation of the ground electrode tip 95 from the ground electrode 30. The reason for this is described below. In a state of use of the spark plug 100, the temperature of the ground electrode 30 gradually increases along a direction toward the surface (the side surfaces 35 and 36) of the ground electrode 30. Accordingly, stress in the ground electrode 30 increases toward the surface. Meanwhile, since the fusion zones 110 and 120 have an intermediate thermal expansion coefficient between those of the ground electrode 30 and the ground electrode tip 95, stress in the ground electrode 30 can be mitigated. Thus, by gradually increasing the thicknesses of the fusion zones 110 and 120 along a direction toward the surface of the ground electrodes 30; in other words, by reducing the thicknesses of the fusion zones 110 and 120 along directions directed away from the side surfaces 35 and 36, respectively, of the ground electrode 30, stress in the ground electrode 30 can be appropriately mitigated, whereby the generation of oxide scale can be restrained, and thus, separation of the ground electrode tip 95 from the ground electrode 30 can be restrained. That is, preferably, the higher the temperature at a position in the ground electrode tip 95 in a state of use of the spark plug 100, the greater the thickness of the fusion zone 98 at the position.

In the sectional view of FIG. 4(C), A1 is the greatest thickness of the fusion zone 110 along the axial direction OD; A2 is the greatest thickness of the fusion zone 120 along the axial direction OD; and A is the total of A1 and A2. B1 is the length from a portion having the greatest thickness of the first fusion zone 110 to an inner end 111 of the first fusion zone 110; B2 is the length from a portion having the greatest thickness of the second fusion zone 120 to an inner end 121 of the second fusion zone 120; and B is the total of B1 and B2. In this case, similar to the first embodiment, preferably, the spark plug 100*b* satisfies the following relational expression (1).

$$1.3 \leq B/A \quad (1)$$

Similar to the first embodiment, employment of this feature can improve welding strength between the ground electrode 30 and the ground electrode tip 95.

In the present embodiment, the inner end 111 of the first fusion zone 110 and the inner end 121 of the second fusion zone 120 are separated from each other. However, the first fusion zone 110 and the second fusion zone 120 may be integral with each other. The definition of the length B in this case will be described later.

In this manner, even when the fusion zones 110 and 120 are formed by radiating a high-energy beam from opposite sides toward the side surfaces 35 and 36 of the ground electrode 30, similar to the first embodiment, welding strength between the ground electrode 30 and the ground electrode tip 95 can be improved.

FIGS. 5(A)-5(C) is a set of explanatory views showing, on an enlarged scale, the distal end portion 33 and its vicinity of the ground electrode 30 in a spark plug 101*b* according to a modification of the second embodiment. FIGS. 5(A), 5(B), and 5(C) correspond to FIGS. 4(A), 4(B), and 4(C), respectively. The present modification differs from the second embodiment shown in FIG. 4 in that the first fusion zone 110 and the second fusion zone 120 are integral with each other. Other configurational features are similar to those of the second embodiment.

In the spark plug 101*b*, since the inner end 111 of the fusion zone 110 and the inner end 121 of the second fusion zone 120 do not exist, the length B cannot be defined by a method similar to that of the above-described second embodiment. Therefore, in the case where the inner end 111 of the first fusion zone 110 and the inner end 121 of the second fusion zone 120 are integral with each other, the length B is defined as the length between a portion having the greatest thickness of the first fusion zone 110 and a portion having the greatest thickness of the second fusion zone 120. In this case, preferably, the spark plug 101*b* satisfies the above-mentioned relational expression (1). Employment of even this feature can improve welding strength between the ground electrode 30 and the ground electrode tip 95. Definition of the length B in the case where the first fusion zone 110 and the second fusion zone 120 are integral with each other is also applied to the following embodiments.

C. Third Embodiment

FIGS. 6(A)-6(C) are sets of explanatory views showing, on an enlarged scale, the distal end portion 33 and its vicinity of the ground electrode 30 in a spark plug 100*c* according to a third embodiment of the present invention. FIG. 6(A) is a view showing the ground electrode 30 as viewed from a direction directed toward a side surface of the ground electrode 30. FIG. 6(B) is a view showing the ground electrode 30 as viewed from a direction directed toward the distal end surface of the ground electrode 30. FIG. 6(C) is a sectional view taken along line X1-X1 of FIG. 6(A). In other words, FIG. 6(C) shows a section which passes through the center of gravity G of the ground electrode tip 95 and is perpendicular to the axial direction OD.

In the spark plug 100*c*, a distal end surface 31 of the ground electrode 30 faces a side surface 93 of the center electrode tip 90. The ground electrode tip 95 is provided on the distal end surface 31 of the ground electrode 30 and forms a spark discharge gap in cooperation with the side surface 93 of the center electrode 90. That is, the spark plug 100*c* is a so-called lateral-discharge-type plug, and the direction of discharge is perpendicular to the axial direction OD. If the center electrode tip 90 is considered as a portion of the center electrode 20, the ground electrode tip 95 can be said to face the side surface of the center electrode 20.

Preferably, as shown in FIG. 6(B), when the fusion zone 98 is projected in the longitudinal direction TD of the ground electrode 30, the projected fusion zone 98 overlaps 70% or more of the area of the ground electrode tip 95. In the example shown in FIG. 6(B), the fusion zone 98 overlaps 100% of the area of the ground electrode tip 95. Employment of this feature can restrain the generation of oxide scale and thus can restrain separation of the ground electrode tip 95 from the ground electrode 30.

Also, as shown in FIG. 6(C), the fusion zone 98 has such a shape as to extend from the side surface 35 of the ground electrode 30, and the thickness of the fusion zone 98 along the longitudinal direction TD gradually reduces along a direction directed away from the side surface 35 of the ground electrode 30. Such the fusion zone 98 can be formed through radiation of a high-energy beam from a direction LD directed toward the side surface 35 of the ground electrode 30.

Meanwhile, in the sectional view of FIG. 6(C), A is the greatest thickness of the fusion zone 98 along the longitudinal direction TD of the ground electrode 30, and B is the length from a portion having the greatest thickness of the fusion zone 98 to the inner end 99 of the fusion zone 98. In this case, similar to the first embodiment, preferably, the spark plug 100*c* satisfies the following relational expression (1).

$$1.3 \leq B/A \quad (1)$$

Similar to the first embodiment, employment of this feature can improve welding strength between the ground electrode 30 and the ground electrode tip 95.

D. Fourth Embodiment

Figure 7A:
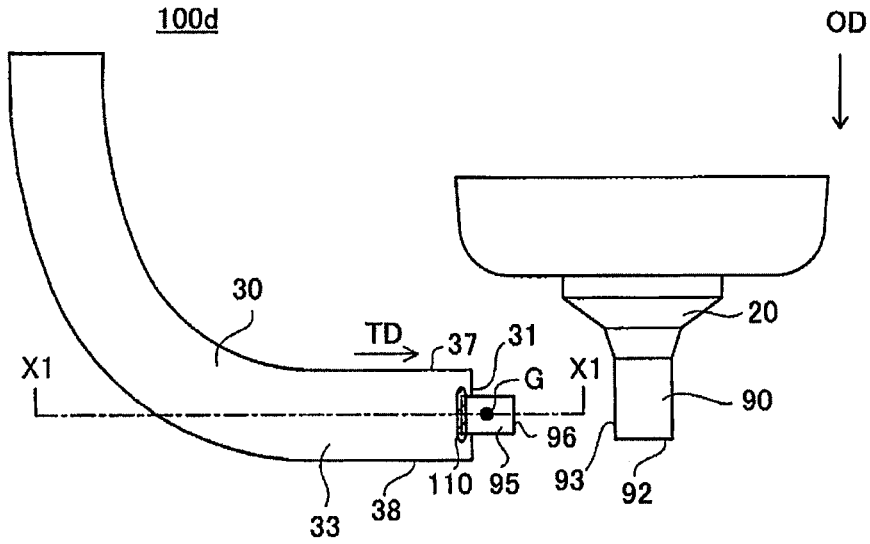
FIGS. 7(A)-7(C) are sets of explanatory views showing, on an enlarged scale, the distal end portion 33 and its vicinity of the ground electrode 30 in a spark plug 100*d* according to a fourth embodiment of the present invention.
Figure 7B:
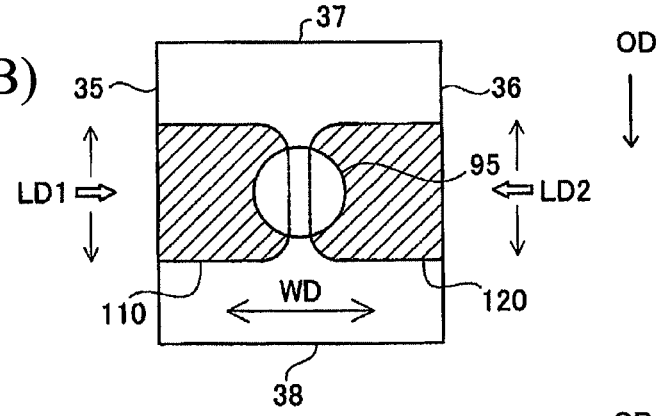
Figure 7C:
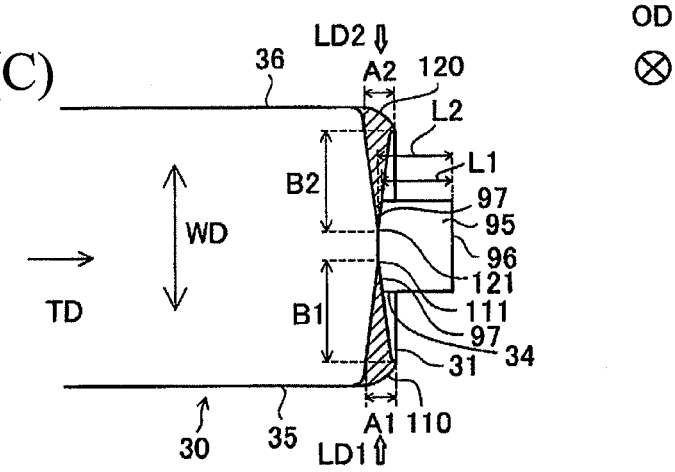

FIGS. 7(A)-7(B) sets of explanatory views showing, on an enlarged scale, the distal end portion 33 and its vicinity of the ground electrode 30 in a spark plug 100*d* according to a fourth embodiment of the present invention. FIGS. 7(A), 7(B), and 7(C) correspond to FIGS. 6(A), 6(B), and 6(C), respectively.

The fourth embodiment differs from the third embodiment shown in FIG. 6 in that, in addition to the first fusion zone 110 having such a shape as to extend from the side surface 35 of the ground electrode 30, the second fusion zone 120 having such a shape as to extend from the side surface 36 of the ground electrode 30 is formed. Other configurational features are similar to those of the third embodiment.

The first fusion zone 110 can be formed through radiation of a high-energy beam from the direction LD1 directed toward the side surface 35 of the ground electrode 30. Similarly, the second fusion zone 120 can be formed through radiation of the high-energy beam from the direction LD2 directed toward the side surface 36 of the ground electrode 30.

Preferably, as shown in FIG. 7(B), when the fusion zones 110 and 120 are projected in the axial direction TD, the projected fusion zones 110 and 120 collectively overlap 70% or more of the area of the ground electrode tip 95. In the present embodiment, the fusion zone 98 overlaps 70% of the area of the ground electrode tip 95. Employment of this feature can restrain the generation of oxide scale and thus can restrain separation of the ground electrode tip 95 from the ground electrode 30.

Also, as shown in FIG. 7(C), the first fusion zone 110 has such a shape as to extend from the side surface 35 of the ground electrode 30, and the thickness of the first fusion zone 110 along the longitudinal direction TD of the ground electrode 30 gradually reduces along a direction directed away from the side surface 35. The second fusion zone 120 has such a shape as to extend from the side surface 36 opposite the side surface 35 of the ground electrode 30, and the thickness of the second fusion zone 120 along the longitudinal direction TD of the ground electrode 30 gradually reduces along a direction directed away from the side surface 36 of the ground electrode 30.

In the sectional view of FIG. 7(C), A1 is the greatest thickness of the fusion zone 110 along the longitudinal direction TD of the ground electrode 30; A2 is the greatest thickness of the fusion zone 120 along the longitudinal direction TD of the ground electrode 30; and A is the total of A1 and A2. B1 is the length from a portion having the greatest thickness of the first fusion zone 110 to the inner end 111 of the first fusion zone 110; B2 is the length from a portion having the greatest thickness of the second fusion zone 120 to the inner end 121 of the second fusion zone 120; and B is the total of B1 and B2. In this case, similar to the first embodiment, preferably, the spark plug 100*d* satisfies the following relational expression (1).

$$1.3 \leq B/A \quad (1)$$

Similar to the first embodiment, employment of this feature can improve welding strength between the ground electrode 30 and the ground electrode tip 95.

E. Fifth Embodiment

FIGS. 8(A)-8(C) are sets of explanatory views showing, on an enlarged scale, the distal end portion 33 and its vicinity of the ground electrode 30 in a spark plug 100*e* according to a fifth embodiment of the present invention. FIG. 8(A) is a view showing the ground electrode 30 as viewed from a direction directed toward a side surface of the ground electrode 30. FIG. 8(B) is a view showing the ground electrode 30 as viewed from a direction directed toward the distal end surface of the ground electrode 30. FIG. 8(C) is a sectional view taken along line X1-X1 of FIG. 8(B). In other words, FIG. 8(C) shows a section which passes through the center of gravity G of the ground electrode tip 95 and is perpendicular to a width direction WD of the ground electrode 30.

The fifth embodiment differs from the third embodiment shown in FIG. 6 in that the fusion zone 98 has such a shape as to extend from an inner side surface 37 of the ground electrode 30. Other configurational features are similar to those of the third embodiment. The inner side surface 37 of the ground electrode 30 is a radially inner surface of the ground electrode 30 with respect to the curve of the ground electrode 30.

Preferably, as shown in FIG. 8(B), when the fusion zone 98 is projected in the longitudinal direction TD of the ground electrode 30, the projected fusion zone 98 overlaps 70% or more of the area of the ground electrode tip 95. In the example shown in FIG. 8(B), the fusion zone 98 overlaps 100% of the area of the ground electrode tip 95. Employment of this feature can restrain the generation of oxide scale in the vicinity of the fusion zone and thus can restrain separation of the ground electrode tip 95 from the ground electrode 30.

Also, as shown in FIG. 8(C), the fusion zone 98 has such a shape as to extend from the inner side surface 37 of the ground electrode 30, and the thickness of the fusion zone 98 along the longitudinal direction TD gradually reduces along a direction directed away from the inner side surface 37 of the ground electrode 30. Such the fusion zone 98 can be formed through radiation of a high-energy beam from the direction LD directed toward the inner side surface 37 of the ground electrode 30. In actuality, after the fusion zone 98 is formed, the ground electrode 30 is bent.

Meanwhile, in the sectional view of FIG. 8(C), A is the greatest thickness of the fusion zone 98 along the longitudinal direction TD of the ground electrode 30, and B is the length from a portion having the greatest thickness of the fusion zone 98 to the inner end 99 of the fusion zone 98. In this case, similar to the first embodiment, preferably, the spark plug 100*e* satisfies the following relational expression (1).

$$1.3 \leq B/A \quad (1)$$

Similar to the first embodiment, employment of this feature can improve welding strength between the ground electrode 30 and the ground electrode tip 95.

F. Sixth Embodiment

FIGS. 9(A)-9(C) are sets of explanatory views showing, on an enlarged scale, the distal end portion 33 and its vicinity of the ground electrode 30 in a spark plug 100*f* according to a sixth embodiment of the present invention. FIGS. 9(A), 9(B), and 9(C) correspond to FIGS. 8(A), 8(B), and 8(C), respectively.

The sixth embodiment differs from the fifth embodiment shown in FIG. 8 in that, in addition to the first fusion zone 110 having such a shape as to extend from the inner side surface 37 of the ground electrode 30, the second fusion zone 120 having such a shape as to extend from an outer side surface 38 of the ground electrode 30 is formed. Other configurational features are similar to those of the fifth embodiment. The outer side surface 38 of the ground electrode 30 is a radially outer surface of the ground electrode 30 with respect to the curve of the ground electrode 30, and the inner side surface 37 of the ground electrode 30 and the outer side surface 38 of the ground electrode 30 are opposite to each other.

The first fusion zone 110 can be formed through radiation of a high-energy beam from the direction LD1 directed toward the inner side surface 37 of the ground electrode 30. Similarly, the second fusion zone 120 can be formed through radiation of the high-energy beam from the direction LD2 directed toward the outer side surface 38 of the ground electrode 30. In actuality, after the fusion zones 110 and 120 are formed, the ground electrode 30 is bent.

Preferably, as shown in FIG. 9(B), when the fusion zones 110 and 120 are projected in the longitudinal direction TD of the ground electrode 30, the projected fusion zones 110 and 120 collectively overlap 70% or more of the area of the ground electrode tip 95. In the present embodiment, the fusion zone 98 overlaps 70% of the area of the ground electrode tip 95. Employment of this feature can restrain the generation of oxide scale and thus can restrain separation of the ground electrode tip 95 from the ground electrode 30.

Also, as shown in FIG. 9(C), the first fusion zone 110 has such a shape as to extend from the inner side surface 37 of the ground electrode 30, and the thickness of the first fusion zone 110 along the longitudinal direction TD of the ground electrode 30 gradually reduces along a direction directed away from the inner side surface 37. The second fusion zone 120 has such a shape as to extend from the outer side surface 38 opposite the inner side surface 37 of the ground electrode 30, and the thickness of the second fusion zone 120 along the longitudinal direction TD of the ground electrode 30 gradually reduces along a direction directed away from the outer side surface 38 of the ground electrode 30.

In the sectional view of FIG. 9(C), A1 is the greatest thickness of the fusion zone 110 along the longitudinal direction TD of the ground electrode 30; A2 is the greatest thickness of the fusion zone 120 along the longitudinal direction TD of the ground electrode 30; and A is the total of A1 and A2. B1 is the length from a portion having the greatest thickness of the first fusion zone 110 to the inner end 111 of the first fusion zone 110; B2 is the length from a portion having the greatest thickness of the second fusion zone 120 to the inner end 121 of the second fusion zone 120; and B is the total of B1 and B2. In this case, similar to the first embodiment, preferably, the spark plug 100*f* satisfies the following relational expression (1).

$$1.3 \leq B/A \quad (1)$$

Similar to the first embodiment, employment of this feature can improve welding strength between the ground electrode 30 and the ground electrode tip 95.

G. Seventh Embodiment

FIGS. 10(A)-10(C) are sets of explanatory views showing, on an enlarged scale, the distal end portion 33 and its vicinity of the ground electrode 30 of a spark plug 100*g* of a seventh embodiment. FIG. 10(A) is a view showing the ground electrode 30 as viewed from a direction directed toward a side surface of the ground electrode 30. FIG. 10(B) is a view showing the ground electrode 30 as viewed from the axial direction OD. FIG. 10(C) is a sectional view taken along line X1-X1 of FIG. 10(A). In other words, FIG. 10(C) shows a section which passes through the center of gravity G of the ground electrode tip 95 and is perpendicular to the longitudinal direction TD of the ground electrode 30.

The seventh embodiment differs from the third embodiment shown in FIG. 6 in that: the ground electrode tip 95 has a square columnar shape; the ground electrode tip 95 is provided on the inner side surface 37 of the ground electrode 30; and a portion of the ground electrode tip 95 projects from the distal end surface 31 of the ground electrode 30. Other configurational features are similar to those of the third embodiment.

Preferably, as shown in FIG. 10(B), when the fusion zone 98 is projected in the axial direction OD, the projected fusion zone 98 overlaps 70% or more of the area of the ground electrode tip 95. In the example shown in FIG. 10(B), the fusion zone 98 overlaps 75% of the area of the ground electrode tip 95. Employment of this feature can restrain the generation of oxide scale in the vicinity of the fusion zone and thus can restrain separation of the ground electrode tip 95 from the ground electrode 30.

Also, as shown in FIG. 10(C), the fusion zone 98 has such a shape as to extend from the side surface 35 of the ground electrode 30, and the thickness of the fusion zone 98 along the axial direction OD gradually reduces along a direction directed away from the side surface 35 of the ground electrode 30. Such the fusion zone 98 can be formed through radiation of a high-energy beam from the direction LD directed toward the side surface 35 of the ground electrode 30.

Meanwhile, in the sectional view of FIG. 10(C), A is the greatest thickness of the fusion zone 98 along the axial direction OD, and B is the length from a portion having the greatest thickness of the fusion zone 98 to the inner end 99 of the fusion zone 98. In this case, similar to the first embodiment, preferably, the spark plug 100*g* satisfies the following relational expression (1).

$$1.3 \leq B/A \quad (1)$$

Similar to the first embodiment, employment of this feature can improve welding strength between the ground electrode 30 and the ground electrode tip 95.

In the example shown in FIG. 10, the ground electrode tip 95 is provided on the inner side surface 37 of the ground electrode 30; however, the ground electrode tip 95 may be provided on the outer side surface 38 of the ground electrode 30. That is, the ground electrode tip 95 may be provided on a surface perpendicular to the axial direction OD of the ground electrode 30. This also applies to an eighth embodiment to be described below.

H. Eighth Embodiment

FIGS. 11(A)-11(C) are sets of explanatory views showing, on an enlarged scale, the distal end portion 33 and its vicinity of the ground electrode 30 in a spark plug 100*h* according to an eighth embodiment of the present invention. FIGS. 11(A), 11(B), and 11(C) correspond to FIGS. 10(A), 10(B), and 10(C), respectively.

The eighth embodiment differs from the seventh embodiment shown in FIG. 10 in that, in addition to the first fusion zone 110 having such a shape as to extend from the side surface 35 of the ground electrode 30, the second fusion zone 120 having such a shape as to extend from the side surface 36 of the ground electrode 30 is formed. Other configurational features are similar to those of the seventh embodiment.

The first fusion zone 110 can be formed through radiation of a high-energy beam from the direction LD1 directed toward the side surface 35 of the ground electrode 30. Similarly, the second fusion zone 120 can be formed through radiation of the high-energy beam from the direction LD2 directed toward the side surface 36 of the ground electrode 30.

Preferably, as shown in FIG. 11(B), when the fusion zones 110 and 120 are projected in the axial direction OD, the projected fusion zones 110 and 120 collectively overlap 70% or more of the area of the ground electrode tip 95. In the present embodiment, the fusion zone 98 overlaps 70% of the area of the ground electrode tip 95. Employment of this feature can restrain the generation of oxide scale and thus can restrain separation of the ground electrode tip 95 from the ground electrode 30.

Also, as shown in FIG. 11(C), the first fusion zone 110 has such a shape as to extend from the side surface 35 of the ground electrode 30, and the thickness of the first fusion zone 110 along the axial direction OD gradually reduces along a direction directed away from the side surface 35. The second fusion zone 120 has such a shape as to extend from the side surface 36 opposite the side surface 35 of the ground electrode 30, and the thickness of the second fusion zone 120 along the axial direction OD gradually reduces along a direction directed away from the side surface 36 of the ground electrode 30.

In the sectional view of FIG. 11(C), A1 is the greatest thickness of the fusion zone 110 along the axial direction OD; A2 is the greatest thickness of the fusion zone 120 along the axial direction OD; and A is the total of A1 and A2. B1 is the length from a portion having the greatest thickness of the first fusion zone 110 to the inner end 111 of the first fusion zone 110; B2 is the length from a portion having the greatest thickness of the second fusion zone 120 to the inner end 121 of the second fusion zone 120; and B is the total of B1 and B2. In this case, similar to the first embodiment, preferably, the spark plug 100*h* satisfies the following relational expression (1).

$$1.3 \leq B/A \quad (1)$$

Similar to the first embodiment, employment of this feature can improve welding strength between the ground electrode 30 and the ground electrode tip 95.

I. Ninth Embodiment

FIGS. 12(A)-12(C) are sets of explanatory views showing, on an enlarged scale, the distal end portion 33 and its vicinity of the ground electrode 30 in a spark plug 100*i* according to a ninth embodiment of the present invention. FIGS. 12(A), 12(B), and 12(C) correspond to FIGS. 5(A), 5(B), and 5(C), respectively. The ninth embodiment differs from the modification of the second embodiment shown in FIG. 5 in that a fusion zone 130 where the groove portion 34 and the ground electrode tip 95 are fused together is additionally formed at a portion perpendicular to the longitudinal direction of the fusion zones 110 and 120 of the interfacial boundary between the ground electrode tip 95 and the groove portion 34 of the ground electrode 30. Other configurational features are similar to those of the second embodiment.

Through formation of the fusion zone 130, a wide portion of the interfacial boundary between the ground electrode tip 95 and the ground electrode 30 can be welded; therefore, welding strength between the ground electrode tip 95 and the ground electrode 30 can be further enhanced.

The fusion zone 130 can be formed by increasing the radiation time of a high-energy beam as compared with the case of forming the fusion zone 110 shown in FIG. 5. Alternatively, the fusion zone 130 can be formed by increasing the radiation output of the high-energy beam. Similar to the modification of the second embodiment, preferably, the fusion zone 130 is additionally formed in other embodiments.

J. Example Experiment on Oxide Scale

In order to examine the spark plugs of the first and second embodiments for the relation between the fusion zone ratio B/A and the incidence of oxide scale, a desktop burner test was conducted. When the desktop burner test was conducted, oxide scale was generated in the vicinity of the fusion zone. The incidence of oxide scale [%] is the ratio of the length of generated oxide scale to the length of the boundary of the fusion zone.

In the desktop burner test, first, the ground electrode 30 was heated with a burner for two minutes to increase the temperature of the ground electrode 30 to 1,100° C. Subsequently, the burner was turned off; the ground electrode 30 was gradually cooled for one minute; and then the ground electrode 30 was again heated with the burner for two minutes to increase the temperature of the ground electrode 30 to 1,100° C. This cycle was repeated 1,000 times, and then the length of oxide scale generated in the vicinity of the fusion zone was measured on a section (corresponding to the sections of FIGS. 3(C) and 4(C)). From the measured length of oxide scale, the incidence of oxide scale was obtained.

Figure 13:
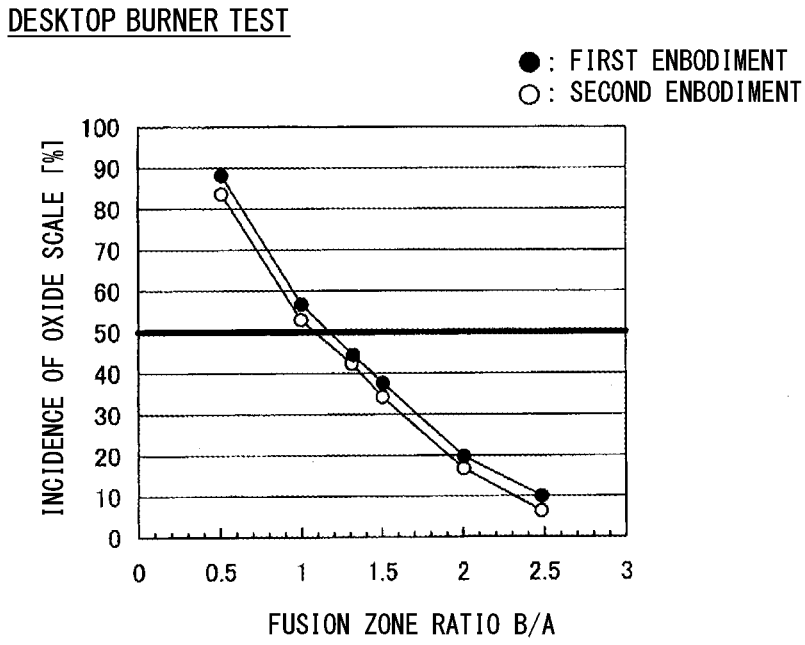
FIG. 13 is a graph showing the relation between the fusion zone ratio B/A and the incidence of oxide scale.

FIG. 13 is a graph showing the relation between the fusion zone ratio B/A and the incidence of oxide scale. The horizontal axis of FIG. 13 represents the fusion zone ratio B/A, and the vertical axis represents the incidence of oxide scale. In FIG. 13, the experimental results of the spark plugs 100 of the first embodiment are plotted with open circles, and the experimental results of the spark plugs 100*b* of the second embodiment are plotted with solid circles.

As is understood from FIG. 13, as the fusion zone ratio B/A increases, the incidence of oxide scale reduces. Conceivably, this is for the following reason: the higher the fusion zone ratio B/A, the more likely the shape of the fusion zone disperses thermal stress in the ground electrode 30 and the ground electrode tip 95; thus, oxide scale becomes unlikely to be generated in the interfacial boundary between the ground electrode tip 95 and the ground electrode 30. At a fusion zone ratio B/A of 1.3 or more, the incidence of oxide scale becomes less than 50%. Therefore, the fusion zone ratio B/A is preferably, 1.3 or more, and in order to further lower the incidence of oxide scale, the fusion zone ratio B/A is more preferably 1.5 or more, particularly preferably 2.0 or more, and most preferably 2.5 or more. In the spark plugs of the embodiments other than the first and second embodiments as well, preferably, have the fusion zones formed such that the fusion zone ratio B/A is 1.3 or more.

All of the samples configured such that, when the fusion zone is projected in the axial direction OD, the projected fusion zone overlaps less than 70% of the area of the ground electrode tip 95, exhibited an incidence of oxide scale of 50% or more. Therefore, preferably, the fusion zone is such that, when the fusion zone is projected in the axial direction OD, the projected fusion zone overlaps 70% or more of the area of the ground electrode tip 95. Similar to the case of the spark plugs of the first and second embodiments, this also applies to the spark plugs of other embodiments.

K. Example Experiment on Amount of Increase in Gap GA

In order to examine the spark plug of the first embodiment (FIG. 3) for the relation between the fusion-zone level difference LA (=L2−L1) and the amount of increase in the gap GA after the test, a desktop spark endurance test was conducted by use of samples which differed in the fusion-zone level difference LA. In the present example experiment, discharges were generated at a frequency of 60 Hz for 100 hours in the atmosphere having a pressure of 0.4 MPa.

Figure 14:
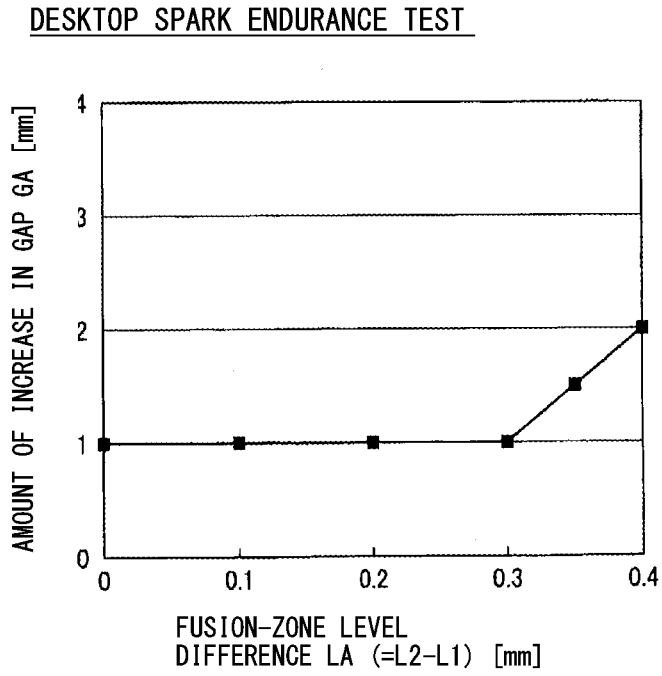
FIG. 14 is a graph showing the relation between the fusion-zone level difference LA and the amount of increase in a gap GA after test.

FIG. 14 is a graph showing the relation between the fusion-zone level difference LA and the amount of increase in the gap GA after the test. The horizontal axis of FIG. 14 represents the fusion-zone level difference LA, and the vertical axis represents the amount of increase in the gap GA (mm) after the desktop spark endurance test was conducted for 100 hours. As is understood from FIG. 14, the smaller the fusion-zone level difference LA, the smaller the amount of increase in the gap GA, indicating that the durability of the ground electrode tip 95 improves. Also, by reducing the fusion-zone level difference LA to less than 0.3, the amount of increase in the gap GA can be restrained to 0.1 mm, indicating that the durability of the ground electrode tip 95 can be further improved. Therefore, preferably, the fusion zone 98 is formed such that the fusion-zone level difference LA is 0.3 mm or less. Similar to the spark plug of the first embodiment, preferably, in the spark plugs of other embodiments, the fusion zone is formed such that the fusion-zone level difference LA is 0.3 mm or less.

L. Modifications

The present invention is not limited to the above-described embodiments or modes, but may be embodied in various other forms without departing from the gist of the invention. For example, the following modifications are possible.

Modification 1

Figure 15:
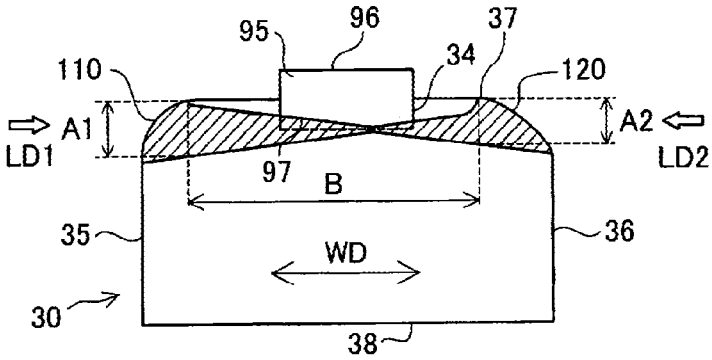
FIG. 15 is an explanatory view showing, in section, the ground electrode 30 of a spark plug in a modified embodiment.

FIG. 15 is an explanatory view showing, in section, the ground electrode 30 of a spark plug in a modified embodiment. FIG. 15 corresponds to FIG. 5(C), which shows a modification of the second embodiment. In the example shown in FIG. 15, the first fusion zone 110 is greater than the second fusion zone 120. In this manner, the first fusion zone 110 and the second fusion zone 120 may differ in size. Similar to the case of the second embodiment, this may also be applied to other embodiments described above.

Modification 2

Figure 16:
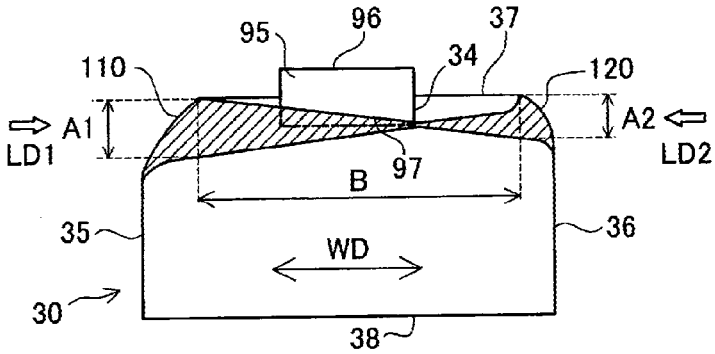
FIG. 16 is an explanatory view showing, in section, the ground electrode 30 of a spark plug in a modified embodiment.

FIG. 16 is an explanatory view showing, in section, the ground electrode 30 of a spark plug in another modified embodiment. FIG. 16 corresponds to FIG. 5(C), which shows a modification of the second embodiment. In the example shown in FIG. 16, the first fusion zone 110 is greater than the second fusion zone 120, and only the first fusion zone 110 forms the interfacial boundary 97. In this manner, both of the first fusion zone 110 and the second fusion zone 120 do not necessarily form the interfacial boundary 97. Similar to the case of the second embodiment, this also applies to other embodiments.

Modification 3

In the first to sixth embodiments and the ninth embodiment described above, the ground electrode tip 95 has a substantially circular columnar shape; however, the ground electrode tip 95 may have a square columnar shape. In the seventh and eighth embodiments, the ground electrode tip 95 has a square columnar shape; however, the ground electrode tip 95 may have a substantially circular columnar shape. That is, the shape of the ground electrode tip 95 is not limited to those of the above-described embodiments, but the ground electrode tip 95 may have any shape.

Modification 4

In the above-described embodiments, the ground electrode 30 has the groove portion 34; however, the groove portion 34 may be eliminated, and the ground electrode tip 95 may be directly welded to a flat surface of the ground electrode 30.

M. Method of Manufacturing Spark Plug

FIGS. 17(A) and 17(B) are a pair of explanatory views showing an example process of formation of the fusion zone 98. In order to form the fusion zone 98 shown in FIG. 3(A), first, a high-energy beam is radiated to the boundary between the ground electrode 30 and the ground electrode tip 95 while being moved relative to the boundary (FIG. 17(A)). By this procedure, as shown in FIG. 17(A), a portion F of the fusion zone 98 which is formed through initial radiation of the high-energy beam is short of fusion depth, and thus, the fusion zone 98 fails to have a substantially symmetrical shape as shown in FIG. 3(A). Conceivably, this is for the following reason: a portion of the fusion zone 98 which is formed through initial radiation of the high-energy beam is not sufficiently heated by the high-energy beam and thus fails to have a sufficiently high temperature for attaining a sufficient fusion depth. Thus, as shown in FIG. 17(B), the high-energy beam is reciprocally moved and radiated to a portion of the fusion zone 98 which could otherwise be short of fusion depth, so as to radiate the high-energy beam twice to the portion. By this procedure, the portion of the fusion zone 98 which could otherwise be short of fusion depth is compensated for the lack of fusion depth, so that the fusion zone 98 can have a substantially symmetrical shape with respect to a baseline BL. When the fusion zone 98 fails to have a substantially symmetrical shape even through two times of radiation of the high-energy beam, the high-energy beam may be radiated three times or more.

In FIG. 17(A), the high-energy beam is moved; however, the boundary between the ground electrode 30 and the ground electrode tip 95 may be moved relative to the high-energy beam. Also, in the manufacturing methods shown in FIGS. 18(A) and 19(A), the high-energy beam is moved; however, similarly, the boundary between the ground electrode 30 and the ground electrode tip 95 may be moved relative to the high-energy beam.

The high-energy beam may be emitted before radiation to the boundary between the ground electrode 30 and the ground electrode tip 95. By this procedure, after output of the high-energy beam is stabilized, formation of the fusion zone can be started, so that accuracy in forming the shape of the fusion zone can be improved.

FIG. 18(A) is an explanatory view showing another example process of formation of the fusion zone 98. FIG. 18(B) is an explanatory diagram showing an example of variation in output of the high-energy beam in the process of formation of the fusion zone 98. As mentioned above, since a portion of the fusion zone 98 which is formed through initial radiation of the high-energy beam is not sufficiently heated, the portion may be short of fusion depth. Therefore, in order for the fusion zone 98 to have a shape substantially symmetrical with respect to the baseline BL, output of the high-energy beam may be varied with relative movement of the high-energy beam. Specifically, for example, as shown in FIG. 18(B), output of the high-energy beam may be varied as follows: output of the high-energy beam is held at a high level for a while after start of radiation, for sufficiently heating a radiated portion; subsequently, output of the high-energy beam is gradually reduced. Even though output of the high-energy beam is gradually reduced, the fusion zone 98*c* can have a shape substantially symmetrical with respect to the baseline BL, for the following reason: heat applied by the high-energy beam is gradually conducted through the fusion zone 98*b* and increases the temperature of a portion which is not yet irradiated with the high-energy beam. Therefore, by means of varying output of the high-energy beam with relative movement of the high-energy beam, the fusion zone 98 can have a shape substantially symmetrical with respect to the baseline BL. The output waveform of the high-energy beam in order for the fusion zone 98 to have a shape substantially symmetrical with respect to the baseline BL is not limited to that shown in FIG. 18(B). Preferably, output of the high-energy beam is adjusted according to the materials and shapes of the ground electrode 30 and the ground electrode tip 95.

FIG. 19(A) is an explanatory view showing a further example process of formation of the fusion zone 98. FIG. 19(B) is an explanatory diagram showing an example of variation in output of the high-energy beam in the process of formation of the fusion zone 98. In order for the fusion zone 98 to have a shape which is substantially symmetrical with respect to the baseline BL, as mentioned above, output of the high-energy beam may be varied with the relative movement of the high-energy beam. Specifically, for example, as shown by the arrows in FIG. 19(A) and shown in FIG. 19(B), output of the high-energy beam is increased until the high-energy beam moves to near the baseline BL, and is then gradually reduced. That is, output of the high-energy beam is increased with the relative movement of the high-energy beam so as to reach a peak value when the high-energy beam moves to near the baseline BL, and is then reduced more gently than in the increasing stage. Even though output of the high-energy beam peaks when the high-energy beam moves to near the baseline BL, the fusion zone 98 can have a shape substantially symmetrical with respect to the baseline BL, for the following reason: heat applied by the high-energy beam is gradually conducted through the fusion zone 98 and increases the temperature of a portion which is not yet irradiated with the high-energy beam. Therefore, by means of varying output of the high-energy beam with the relative movement of the high-energy beam as represented by the waveform shown in FIG. 19(B), the fusion zone 98 can have a shape which is substantially symmetrical with respect to the baseline BL.

An example method of forming the fusion zone 98 of the first embodiment has been described above. The fusion zones of other embodiments can also be formed similarly by appropriately adjusting, for example, output, radiation time, and the number of times of radiation of the high-energy beam.

Having described the invention, the following is claimed:

1. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided at a position on the ground electrode which faces a forward end surface of the center electrode, and adapted to form a gap in cooperation with the forward end surface of the center electrode; and a fusion zone where the ground electrode and the noble metal tip are fused together formed in at least a portion of an interfacial region between the ground electrode and the noble metal tip, wherein when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone has such a shape as to extend from a side surface of the ground electrode, a thickness of the fusion zone along the axial direction gradually reduces along a direction directed away from the side surface of the ground electrode, and a relational expression $1.3 \leq B/A$ is satisfied, where A is a greatest thickness of the fusion zone along the axial direction, and B is a length from a portion having the greatest thickness of the fusion zone to an inner end of the fusion zone.

2. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided at a position on the ground electrode which faces a forward end surface of the center electrode, and adapted to form a gap in cooperation with the forward end surface of the center electrode; and a fusion zone where the ground electrode and the noble metal tip are fused together formed in at least a portion of an interfacial region between the ground electrode and the noble metal tip, wherein when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the axial direction gradually reduces along a direction directed away from the first side surface of the ground electrode, a thickness of the second fusion zone along the axial direction gradually reduces along a direction directed away from the second side surface of the ground electrode, and a relational expression $1.3 \leq B/A$ is satisfied, where A is a total of A1 and A2, A1 being a greatest thickness of the first fusion zone along the axial direction, and A2 being a greatest thickness of the second fusion zone along the axial direction, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

3. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a distal end surface of the ground electrode and adapted to form a gap in cooperation with a side surface of the center electrode; and a fusion zone where the ground electrode and the noble metal tip are fused together formed in at least a portion of an interfacial region between the ground electrode and the noble metal tip, wherein when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to the axial direction, the fusion zone has such a shape as to extend from a side surface of the ground electrode, a thickness of the fusion zone along the longitudinal direction of the ground electrode gradually reduces along a direction directed away from the side surface of the ground electrode, and a relational expression $1.3 \leq B/A$ is satisfied, where A is a greatest thickness of the fusion zone along the longitudinal direction of the ground electrode, and B is a length from a portion having the greatest thickness of the fusion zone to an inner end of the fusion zone.

4. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a distal end surface of the ground electrode and adapted to form a gap in cooperation with a side surface of the center electrode; and a fusion zone where the ground electrode and the noble metal tip are fused together formed in at least a portion of an interfacial region between the ground electrode and the noble metal tip, wherein when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to the axial direction, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the longitudinal direction of the ground electrode gradually reduces along a direction directed away from the first side surface of the ground electrode, a thickness of the second fusion zone along the longitudinal direction of the ground electrode gradually reduces along a direction directed away from the second side surface of the ground electrode, and a relational expression $1.3 \leq B/A$ is satisfied, where A is a total of A1 and A2, A1 being a greatest thickness of the first fusion zone along the longitudinal direction of the ground electrode, and A2 being a greatest thickness of the second fusion zone along the longitudinal direction of the ground electrode, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

5. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a distal end surface of the ground electrode and adapted to form a gap in cooperation with a side surface of the center electrode; and a fusion zone where the ground electrode and the noble metal tip are fused together formed in at least a portion of an interfacial region between the ground electrode and the noble metal tip, wherein when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to a width direction of the ground electrode, the fusion zone has such a shape as to extend from an inner side surface of the ground electrode, a thickness of the fusion zone along the longitudinal direction of the ground electrode gradually reduces along a direction directed away from the inner side surface of the ground electrode, and a relational expression $1.3 \leq B/A$ is satisfied, where A is a greatest thickness of the fusion zone along the longitudinal direction of the ground electrode, and B is a length from a portion having the greatest thickness of the fusion zone to an inner end of the fusion zone.

6. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a distal end surface of the ground electrode and adapted to form a gap in cooperation with a side surface of the center electrode; and a fusion zone where the ground electrode and the noble metal tip are fused together formed in at least a portion of an interfacial region between the ground electrode and the noble metal tip, wherein when the fusion zone is projected in a longitudinal direction of the ground electrode, the projected fusion zone overlaps 70% or more of an area of the noble metal tip; and as viewed on a section which passes through a center of gravity of the noble metal tip and is perpendicular to a width direction of the ground electrode, the fusion zone includes a first fusion zone having such a shape as to extend from an inner side surface of the ground electrode, and a second fusion zone having such a shape as to extend from an outer side surface opposite the inner side surface of the ground electrode, a thickness of the first fusion zone along the longitudinal direction of the ground electrode gradually reduces along a direction directed away from the inner side surface of the ground electrode, a thickness of the second fusion zone along the longitudinal direction of the ground electrode gradually reduces along a direction directed away from the outer side surface of the ground electrode, and a relational expression $1.3 \leq B/A$ is satisfied, where A is a total of A1 and A2, A1 being a greatest thickness of the first fusion zone along the longitudinal direction of the ground electrode, and A2 being a greatest thickness of the second fusion zone along the longitudinal direction of the ground electrode, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

7. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a surface of the ground electrode perpendicular to the axial direction, partially projecting from a distal end surface of the ground electrode, and adapted to form a gap in cooperation with a side surface of the center electrode; and a fusion zone where the ground electrode and the noble metal tip are fused together formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone has such a shape as to extend from a side surface of the ground electrode, a thickness of the fusion zone along the axial direction gradually reduces along a direction directed away from the side surface of the ground electrode, and a relational expression $1.3 \leq B/A$ is satisfied, where A is a greatest thickness of the fusion zone along the axial direction, and B is a length from a portion having the greatest thickness of the fusion zone to an inner end of the fusion zone.

8. A spark plug comprising:

an insulator having an axial bore extending therethrough in an axial direction;

a center electrode provided in a forward end portion of the axial bore;

a substantially tubular metallic shell which holds the insulator;

a ground electrode whose one end is attached to a forward end portion of the metallic shell and whose other end faces a forward end portion of the center electrode;

a noble metal tip provided on a surface of the ground electrode perpendicular to the axial direction, partially projecting from a distal end surface of the ground electrode, and adapted to form a gap in cooperation with a side surface of the center electrode; and a fusion zone where the ground electrode and the noble metal tip are fused together formed in at least a portion of an interfacial region between the ground electrode and the noble metal tip;

when the fusion zone is projected in the axial direction, the projected fusion zone overlaps 70% or more of an area of the noble metal tip; and as viewed on a section which passes through a center of gravity of the noble metal tip and is perpendicular to a longitudinal direction of the ground electrode, the fusion zone includes a first fusion zone having such a shape as to extend from a first side surface of the ground electrode, and a second fusion zone having such a shape as to extend from a second side surface opposite the first side surface of the ground electrode, a thickness of the first fusion zone along the axial direction gradually reduces along a direction directed away from the first side surface of the ground electrode, a thickness of the second fusion zone along the axial direction gradually reduces along a direction directed away from the second side surface of the ground electrode, and a relational expression $1.3 \leq B/A$ is satisfied, where A is a total of A1 and A2, A1 being a greatest thickness of the first fusion zone along the axial direction, and A2 being a greatest thickness of the second fusion zone along the axial direction, B is a total of B1 and B2 when the first fusion zone and the second fusion zone are separated from each other, B1 being a length from a portion having the greatest thickness of the first fusion zone to an inner end of the first fusion zone, and B2 being a length from a portion having the greatest thickness of the second fusion zone to an inner end of the second fusion zone, and B is a length between a portion having the greatest thickness of the first fusion zone and a portion having the greatest thickness of the second fusion zone when the first fusion zone and the second fusion zone are integral with each other.

9. A spark plug according to any one of claims 1 to 6, characterized in that the fusion zone is not formed in a discharge surface of the noble metal tip which forms the gap in cooperation with the center electrode.

10. A spark plug according to any one of claims 1 to 6, characterized in that a relational expression $L2-L1 \leq 0.3$ mm is satisfied, where L1 is a length from a discharge surface of the noble metal tip which faces the center electrode, to a shallowest portion of the fusion zone, and L2 is a length from the discharge surface to a deepest portion of the fusion zone.

11. A spark plug according to any one of claims 1 to 6, characterized in that, as viewed on the section, half or more of an interfacial boundary between the fusion zone and the noble metal tip forms an angle of 0 degree to 10 degrees with respect to a discharge surface of the noble metal tip which faces the center electrode.

12. A spark plug according to any one of claims 1 to 8, characterized in that:

a portion of the noble metal tip is embedded in a groove portion formed in the ground electrode, and as viewed on the section, a fusion zone where the groove portion and the noble metal tip are fused together is additionally formed at a portion perpendicular to a longitudinal direction of the fusion zone of an interfacial boundary between the groove portion and the noble metal tip.

13. A spark plug according to any one of claims 1 to 8, characterized in that the fusion zone is formed by radiating a high-energy beam from a direction parallel to an interfacial boundary between the ground electrode and the noble metal tip.

14. A spark plug according to any one of claims 1 to 8, characterized in that the fusion zone is formed by radiating a high-energy beam from a direction oblique to an interfacial boundary between the ground electrode and the noble metal tip.

15. A spark plug according to any one of claims 1 to 8, characterized in that the fusion zone is formed by irradiating an interfacial boundary between the ground electrode and the noble metal tip with a fiber laser beam or an electron beam.

* * * * *